US005818481A

United States Patent [19]

Hotomi et al.

[11] Patent Number: 5,818,481

[45] Date of Patent: Oct. 6, 1998

[54] INK JET PRINTING HEAD HAVING A PIEZOELECTRIC DRIVER MEMBER

[75] Inventors: Hideo Hotomi, Nishinomiya; Kenji Masaki, Nagaokakyo; Kusunoki Higashino, Osaka, all of Japan

[73] Assignee: Minolta Co., Ltd., Osaka, Japan

[21] Appl. No.: 597,208

[22] Filed: Feb. 6, 1996

[30] Foreign Application Priority Data

Feb. 13, 1995 [JP] Japan ..... 7-024342
Feb. 27, 1995 [JP] Japan ..... 7-038095

[51] Int. Cl.[6] ..... B41J 2/045

[52] U.S. Cl. ..... 347/68; 347/69

[58] Field of Search ..... 347/44, 47, 48, 347/55, 68, 69, 70; 310/311, 323, 333, 367, 368, 369

[56] References Cited

U.S. PATENT DOCUMENTS 4,189,734 2/1980 Kyser et al. .
4,752,788 6/1988 Yasuhara et al. ..... 310/328 X
5,248,998 9/1993 Ochiai et al. ..... 347/69 X
5,311,219 5/1994 Ochiai et al. ..... 347/68
5,363,133 11/1994 Sugahara et al. ..... 347/69
5,428,382 6/1995 Shimosato et al. ..... 347/71
5,432,540 7/1995 Hiraishi ..... 347/69
5,471,232 11/1995 Hosono et al. ..... 347/70

FOREIGN PATENT DOCUMENTS 6-182998 7/1994 Japan .

*Primary Examiner*—Edward Tso
*Attorney, Agent, or Firm*—Sidley & Austin

[57] ABSTRACT

Disclosed is an ink jet head which ejects an ink drop from an ink room throughout an orifice in response to deformation of piezoelectric member. The ink jet head has a non-piezoelectric member having a groove; a film provided on the non-piezoelectric member to cover the groove, the space formed between the groove and the film being uses as the ink room; a substrate provided opposing to the film; and a piezoelectric member having a first surface, the first surface contacting with the substrate corresponding to the ink room. A part of the first surface is fixedly connected with the substrate. The remaining part of the first surface is facing to the substrate, but is not fixedly connected.

24 Claims, 19 Drawing Sheets

INK JET PRINTING HEAD HAVING A PIEZOELECTRIC DRIVER MEMBER

BACKGROUND OF THE INVENTION

1. Field of the Invention

This invention relates to an ink jet head that jets ink droplets onto a recording medium such as paper in response to an image signal.

2. Description of Related Arts

Conventionally, an on-demand type of ink jet head that records onto a medium to be recorded such as paper by applying a voltage to a piezoelectric body in response to an image signal to pressurize ink based on the deformation of a piezoelectric body and eject ink droplets from a nozzle has been used in a recording apparatus such as a printer.

For this type of ink jet head, for example, the ink jet head shown in FIG. 1 has been disclosed in U.S. Pat. No. 4,752,788. This ink jet head 60 comprises a piezoelectric member 62 on which a plurality of concave portions 61 are formed and a cover plate 63 which covers the plurality of concave portions 61 as well as an ink chamber 64 which is formed on the inside of a concave portion 61. Further, a convex portion 65 is formed on the bottom surface of the plurality of concave portions 61 with electrodes 66, 67 arranged on the top of this convex portion 65 and on the back surface of the piezoelectric member 62 at a position corresponding to the above-mentioned convex portion 65, respectively.

In an ink jet head 60 constructed this way, the capacity of the ink chamber 64 is changed by deformation of the convex portion 65 of the piezoelectric member 62 and ink droplets are discharged from a nozzle (not shown in FIG. 1) by means of pressurizing the ink which fills the ink chamber 64. The deformation of the convex portion 65 is caused by applying a voltage between the electrodes 66, 67.

Moreover, in Japanese Unexamined Laid-open Patent Application Hei 6-143563, the ink jet head shown in FIG. 2 has been proposed. In this ink jet head 70, an elastic membrane 73 is joined to the top of a flowpath substrate 72 made of a non-piezoelectric body which is formed from a plurality of concave portions 71 formed in parallel which are used for an ink chamber 74. On the top of this elastic membrane 73 are arranged a plurality of piezoelectric vibrator bodies 76 for the drive and dummy piezoelectric vibrator bodies 77 which are attached to the substrate 75. The piezoelectric vibrator bodies 76 for the drive and dummy piezoelectric vibrator bodies 77 are bodies which were separated by a slit process after attaching one piezoelectric plate to the substrate 75. Then, the junction body of the flowpath substrate 72, elastic membrane 73, piezoelectric vibrator bodies 76, 77 and the substrate 75 is held by two rigid fixing plates 78, 79.

In an ink jet head 70 constructed this way, ink droplets are discharged from a nozzle (not shown in FIG. 2) by means of changing the capacity of the ink chamber 74 via the elastic membrane 73 to pressurize the ink by applying a voltage to the piezoelectric vibrator bodies 76 for the drive which deforms the bodies.

In Japanese Unexamined Laid-open Patent Application Hei 6-71878, the ink jet head shown in FIG. 3 has been further proposed. In like manner to the above-mentioned ink jet head 70, this ink jet head 80 pressurizes an ink chamber 84 via an elastic membrane 83 by means of a pressure generating member 86 to discharge ink droplets. However, the elastic membrane 83 is gently pressed against the inside of the ink chamber 84 with the pressure generating member 86 in a stationary state. The tip of the pressure generating member 86 and the elastic membrane 83 are not joined, but ¼ of the natural vibration cycle of the elastic membrane 83, which forms one wall of the ink chamber 84, is made longer than the contraction time of the pressure generating member 86. Consequently, in restoring the pressure generating member 86 to its original state after it deforms from a stationary state pressing up the elastic membrane 83 even further to discharge ink droplets, the elastic membrane 83 is separated once from the pressure generating member 86 without following the pressure generating member 86 and then withdraws.

However, the above-mentioned ink jet heads 60, 70 and 80 had the following problems.

At first, in the above-mentioned ink jet head 60, there is a problem in which even though the convex portion 65 is deformed and the ink pressurized, not only does the discharge rate drop due to ink being forced into the gap between the sidewalls of the convex portion 65 and the concave portion 61 but ink penetrates into the convex portion 65 causing the resistance to lower resulting in effective voltage not being applied due to the convex portion 65 which is the piezoelectric body and the ink making direct contact, thereby the displacement quantity of the convex portion 65 drops making it difficult to discharge the ink droplets.

Furthermore, in the above-mentioned ink jet head 70, because there is solid attachment of the entire surface between the piezoelectric vibrator bodies 76 for the drive and the substrate 75 which extend in the depth direction (a direction orthogonal to the paper plane in FIG. 2), the separate vibrations of the piezoelectric vibrator bodies 76 propagate to the adjacent piezoelectric vibrator layer 76 also through the substrate 75 causing a coupled displacement to occur.

Therefore, a problem occurs in which there is unnecessary discharge of ink droplets from the ink chamber 74 or irregularity in the ink flow inside the ink chamber 74 even though the ink does not discharge resulting in uneven diameter of the ink droplets at the subsequent discharge. In other words, a mutual interference of the ink discharge characteristics (which is called "cross talk") occurs, resulting in poor print quality.

In addition, because the dummy piezoelectric vibrator bodies 77 play the role of spacer between the elastic membrane 73 and the substrate 75, causing the elastic membrane 73 which covers the ink chamber 74 to form a flat surface, the elastic membrane 73 itself also vibrates along with the vibrations of the piezoelectric vibrator bodies 76. Therefore, there is also another problem in which it is necessary to wait until the vibrations of this elastic membrane 73 subside to stabilize the discharge of the subsequent ink droplet resulting in insufficient high frequency response characteristics which are needed when increasing the printing speed.

A problem in the ink jet head 80 is similar to the above-mentioned ink jet head 70, in which there are insufficient high frequency response characteristics because of an insufficient pressing of the elastic membrane 83 into the ink chamber 84 by means of the pressure generating member 86 as well as the elastic membrane 83 gradually returning to its original state and making contact with the pressure generating member 86 one more time after separating once without following the restoration action of the pressure generating member 86.

Further, in the pressure generating member 86 of the above-mentioned ink jet head 80, a lengthwise vibration mode is used in which a voltage is applied to a thin square plate that is a laminated piezoelectric member and which causes vibrations in the lengthwise direction, at a right angle to the polarized direction of the piezoelectric member. Therefore, there is also a problem in which bending deformation occurs easily during repeated use, resulting in insufficient deformation stabilization characteristics which cause variations in the ink propulsion and making it impossible to stabilize the dot diameter of the ink adhering to the recording paper.

SUMMARY OF THE INVENTION

Accordingly, the purpose of the present invention is to solve the above-mentioned problems to provide an ink jet recording apparatus that achieves highly efficient and stable propulsion of ink droplets. A further purpose of the present invention is to provide an ink jet recording apparatus with excellent high frequency response characteristics.

To achieve at least one of the above mentioned purposes, the ink jet head of the present invention comprises: a first member; a piezoelectric member which is provided on said first member, said piezoelectric member having a surface facing to said first member, part of said surface being fixedly connected with said first member; a second member on which a groove is formed corresponding to said piezoelectric member; and a film which is provided on said second member to cover said groove, a space formed by said groove and said plate being used as an ink room in which ink is filled, said first plate being assembled with said second plate via said film so that said piezoelectric member push said film into said ink room.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
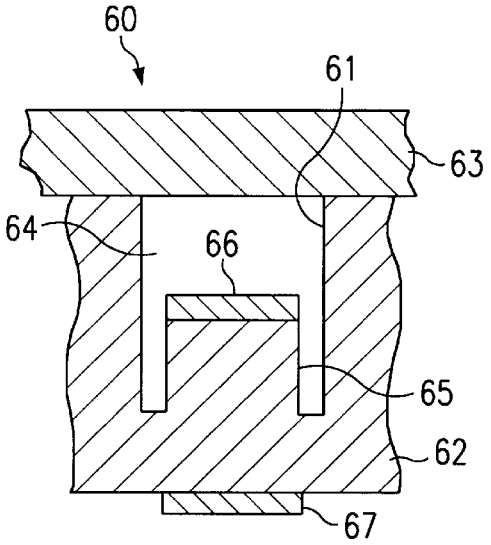
FIG. 1 (PRIOR ART)
FIG. 1 is a partial sectional view of an example of a conventional ink jet head.
Figure 2:
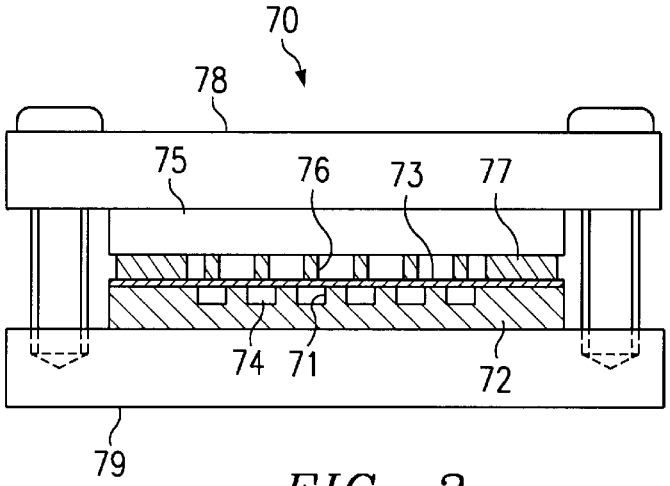
FIG. 2 (PRIOR ART)
FIG. 2 is a partial sectional view of an example of a conventional ink jet head.
Figure 3:
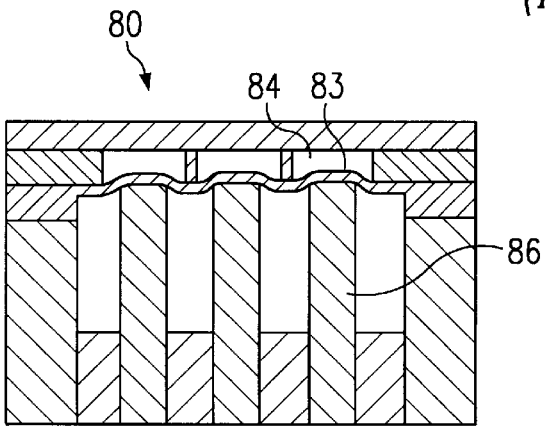
FIG. 3 (PRIOR ART)
FIG. 3 is a partial sectional view of an example of a conventional ink jet head.

Referring now to the drawings, preferred embodiments of the present invention will be described.

[Overall Construction]

Figure 4:
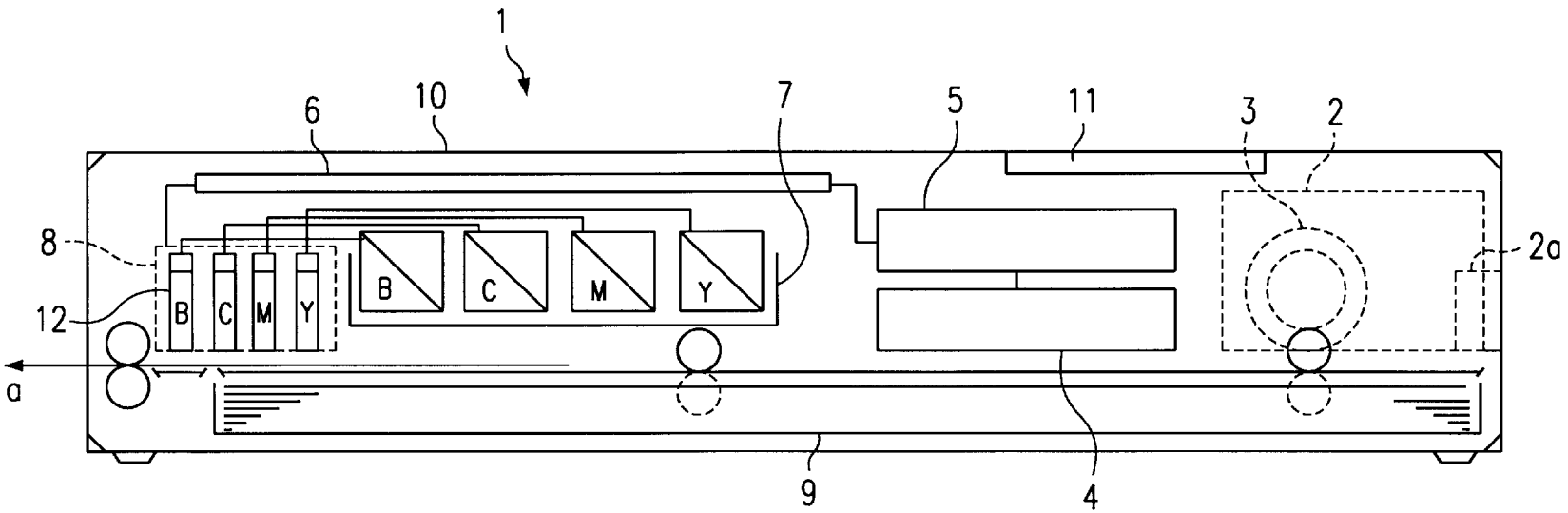
FIG. 4 is an outline of the construction of the ink jet recording apparatus which employs the ink jet head of the present invention.

FIG. 4 shows in broad outline the overall construction of the ink jet recording apparatus which employs the ink jet head of the present invention. This ink jet recording apparatus 1 is broadly divided into a power supply portion 2 equipped with a connector 2*a*, a drive system 3, a mechanical controller 4, a memory 5, a controller 6 (e.g., an electric circuit), an ink supply portion 7, a scan carriage 8, a feeder portion 9, a case 10, and an operation panel 11. The above-mentioned scan carriage 8 is provided to be able to scan in a direction (i.e., a direction orthogonal to the paper plane in FIG. 4) at a right angle to the direction the paper passes (direction of arrow a) and within the carriage along the direction the paper passes are arranged four ink jet heads 12 for each color of black, cyan, magenta and yellow as well as ink discharge nozzles which face downward.

Figure 5:
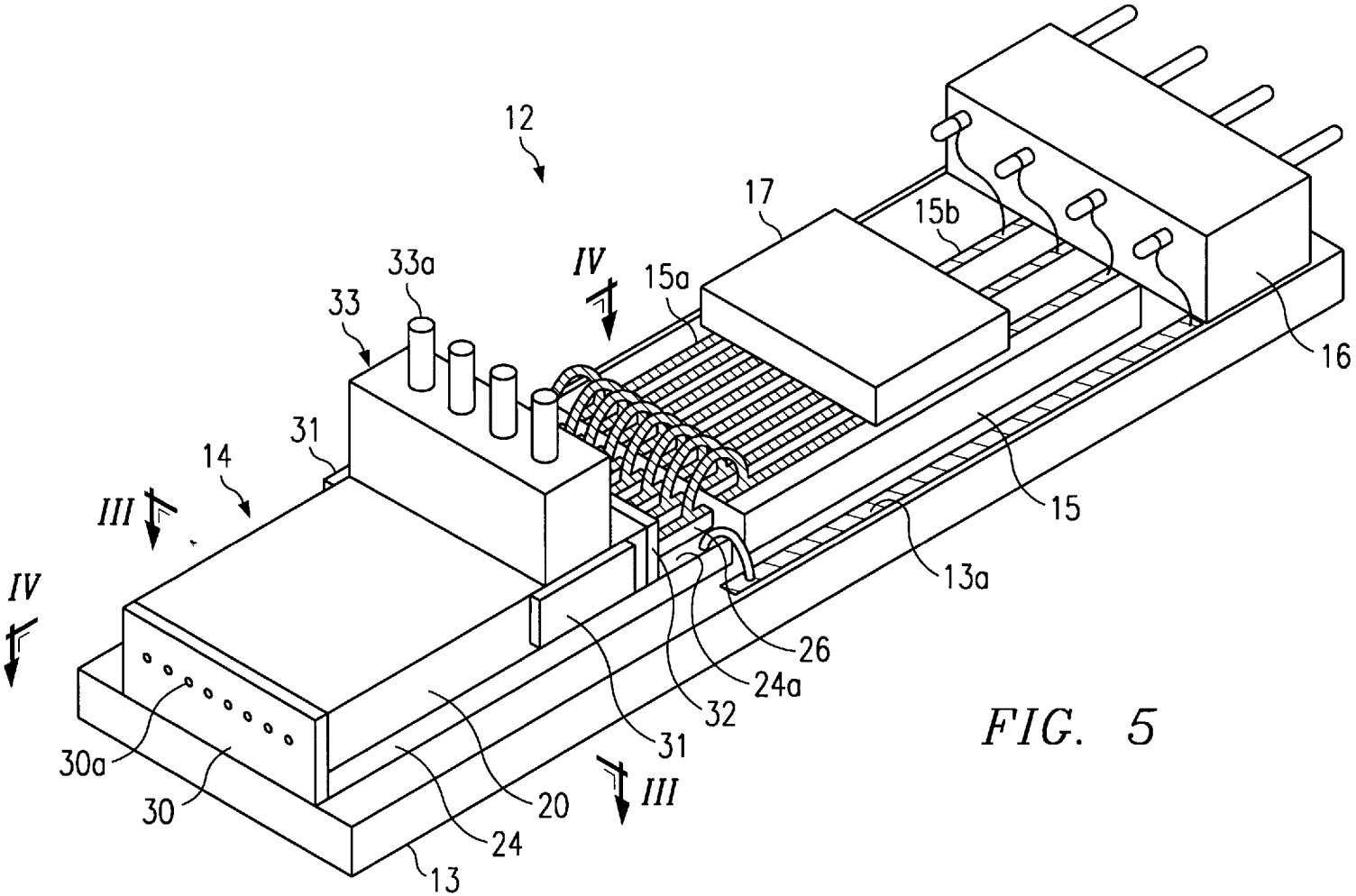
FIG. 5 is a perspective view of an outline of the construction of the ink jet head of the present invention.

As shown in FIG. 5, the ink jet heads 12 are constructed such that an ink discharge portion 14, a terminal plate 15 and a connector 16 are arranged in order from the forward direction (i.e., lower left in FIG. 5) on a base plate 13.

The first embodiment to the fifth embodiment which describe the construction of the principal parts of the above-mentioned ink jet heads 12 will be described in detail below.

[First Embodiment]

Figure 6:
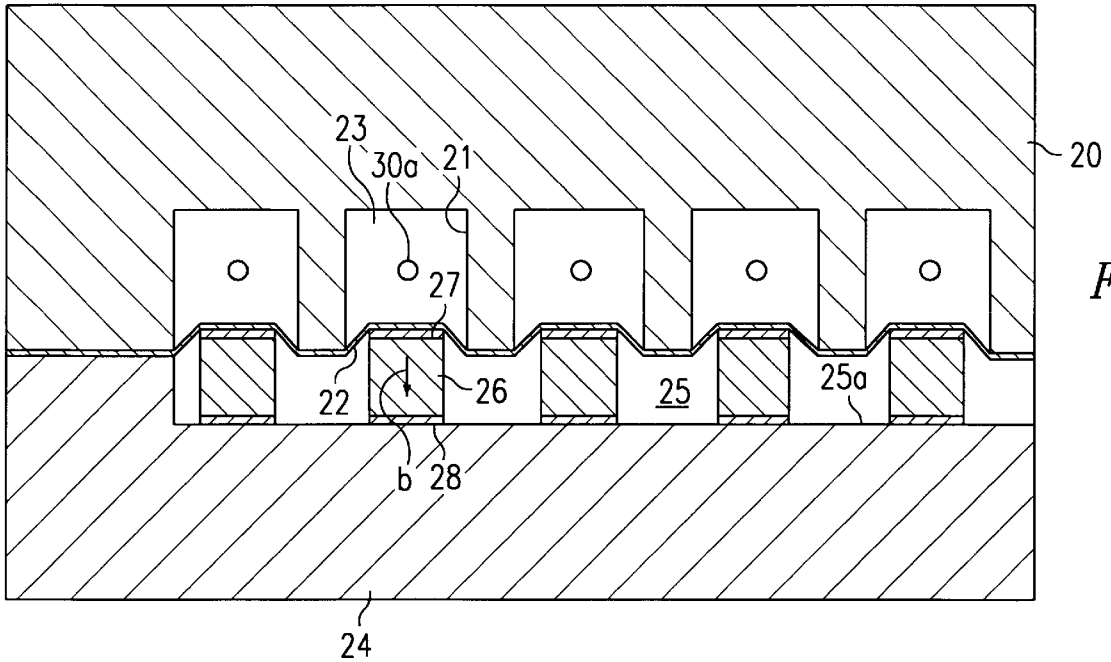
FIG. 6 is a crosswise sectional view of the principal parts of the ink jet head of the first embodiment.

The construction of the ink jet head of the first embodiment of the present invention will be described referring to FIG. 6 to FIG. 18. The top plate 20 of the ink discharge portion 14 is made of a plate which is comprised by a non-piezoelectric member such as alumina, for example. As shown in FIG. 6, a plurality of channel-shaped concave portions 21 are formed on the lower surface of the top plate 20. These concave portion 21 are formed at a fixed pitch in the axial direction of the top plate 20 and they extend in the lengthwise direction of the top plate 20 parallel to each other.

A partition 22 comprised by a membrane is attached to the surface where the concave portion 21 of the top plate 20 is formed and an ink chamber 23 is then formed inside the concave portion 21 which is covered by this partition 22. The partition 22 is made of aramide resin, for example.

A substrate 24 is provided via the partition 22 on the side of the surface where the concave portion 21 of the top plate 20 is formed. This substrate 24 is comprised by a non-piezoelectric member like the top plate 20 and a concave portion 25 is formed on the surface opposite the above-mentioned concave portion 21.

A plurality of piezoelectric bodies 26 which correspond to each concave portion 21 of the top plate 20 are arranged on the bottom surface 25*a* of the concave portion 25. The piezoelectric bodies 26 are, for example, comprised by a PZT piezoelectric ceramic and form a long slender shaft-shaped body in the direction along the ink chamber 23. The upper portion of the piezoelectric body 26 is shallowly fit along the concave portion 21 of the top plate 20. Thereby, the partition 22 is bent and pushed into the inside of the ink chamber 23.

An individual electrode 27 is set on the upper surface of the piezoelectric body 26 that makes contact with the partition 22. Conversely, a common electrode 28 is set on the lower surface of the piezoelectric body 26 that makes contact with the substrate 24.

Moreover, as shown in FIG. 6, the polarization direction (direction of arrow b) of the piezoelectric body 26 is arranged so the direction becomes parallel to the direction of the electric field which is formed by means of applying a voltage to the individual electrode 27 and the common electrode 28. Further, the surface where the individual electrode 27 of the piezoelectric body 26 is formed can either be or not be adhered to the partition 22. When the surface where the individual electrode 27 of the piezoelectric body 26 is formed is adhered to the partition 22, the following action of the partition 22 with respect to the displacement of the piezoelectric body 26 becomes more reliable and the high frequency response characteristics are improved.

Figure 7:
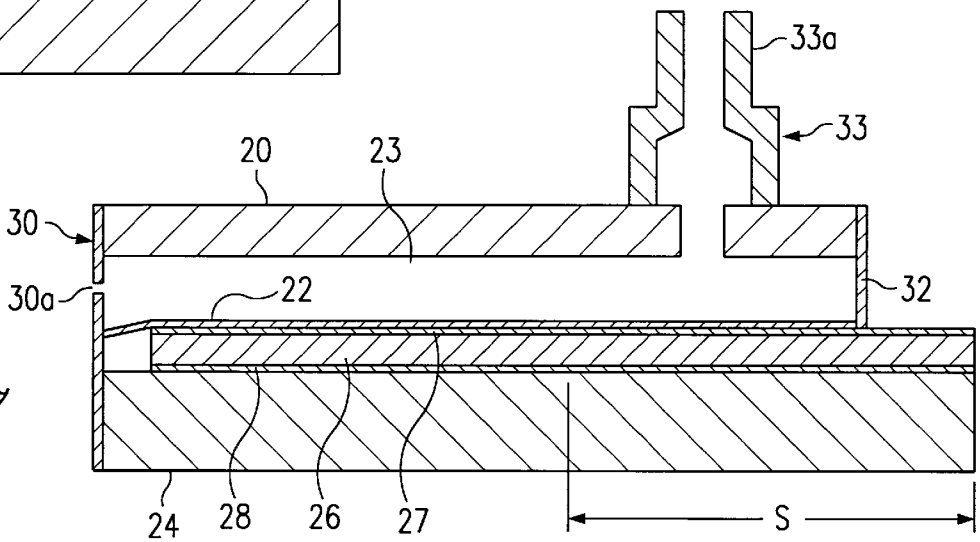
FIG. 7 is a lengthwise sectional view of the principal parts of the ink jet head of the first embodiment.

As shown in FIG. 7, the above-mentioned piezoelectric body 26 is solidly adhered to the substrate 24 using a conductive adhesive agent at region s of the rear end of the body (right in FIG. 7) and the front end portion of the body becomes a free end. Thereby, when a voltage is applied to the piezoelectric body 26 and an electric field is formed, the portion of the piezoelectric body 26 which is not fixed and is positioned more forward than region s functions to raise the partition 22 thereby pressurizing the ink chamber 23.

On the surface of the front end of the integrated body of the above-mentioned top plate 20, partition 22 and substrate 24, a nozzle plate 30 is solidly attached which is comprised by, for example, polyimide film approximately 25 to 200 $\mu$m thick. On this nozzle plate 30, a plurality of nozzle holes 30*a* are formed at a pitch equal to the above-mentioned ink chamber 23 by means of, for example, an excimer laser. This pitch is, for example, approximately 42.3 to 254 $\mu$m (pixel density: 600 to 100 dpi).

As shown in FIG. 5, on the surface of both sides of the above-mentioned top plate 20 are attached side plates 31 which block the openings of both ends of an ink inlet (not shown in figure, described later) that connects to each ink chamber 23. Conversely, on the surface of the rear end of the top plate 20 is attached a back plate 32 that blocks the rear end opening of each ink chamber 23. Furthermore, on the upper surface of the top plate 20 is attached a manifold 33 for the purpose of supplying ink to the ink chamber 23. A plurality (or even one) of ink supply openings 33*a* are arranged protruding on the upper portion of this manifold 33. Further, in this embodiment, although ink is supplied from the upper surface of the top plate 20 to each ink chamber 23, the ink can be supplied from the rear end of each ink chamber 23.

As shown in FIG. 5 and FIG. 7, the above-mentioned piezoelectric body 26 extends toward the rear passing the back plate 32 attached to the rear end of the top plate 20. Then, the individual electrodes 27 on the rear ends of the piezoelectric bodies 26 are connected to a plurality of conductors 15*a* arranged on the upper surface of the terminal plate 15, respectively, by means of wire bonding and are further connected to a controller 6 (see FIG. 4) which is a voltage application means via a conductor 15*b* and a connector 16. This controller 6 applies a voltage to the piezoelectric body 26 in response to an image signal.

On the other hand, the surface 24*a* at the rear end of the substrate 24 conducts electricity to the common electrode 28 of each piezoelectric body 26 through a conductive adhesive agent layer. Therefore, if the surface 24*a* at the rear end of the substrate 24 and a conductor 13*a*, which is disposed on the top of the base plate 13, are connected by means of wire bonding at one location, etc., each common electrode 28 is connected to the controller 6 via the connector 16.

Continuing, the manufacturing process of the ink jet head 12 comprising the above-mentioned construction is described referring to FIG. 8 to FIG. 12.

Figure 8A:
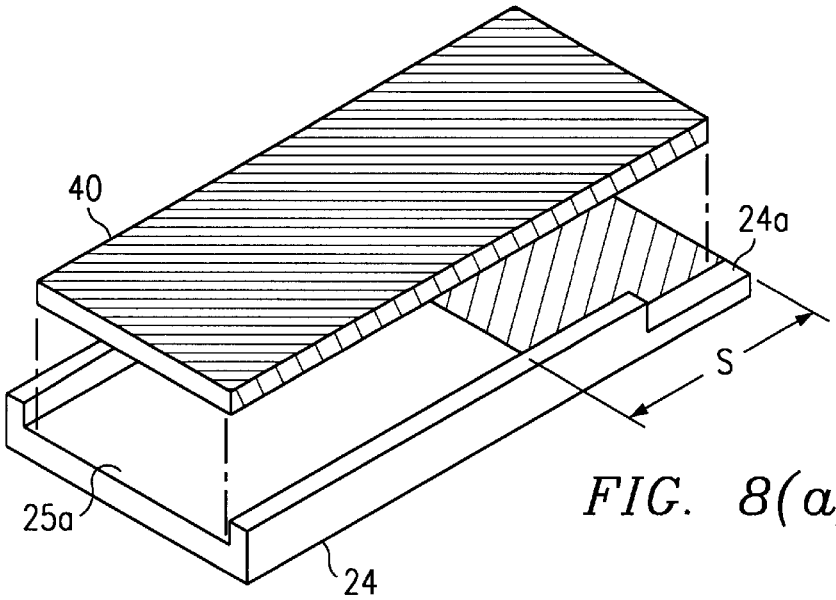
FIG. 8(*a*), FIG. 8(*b*) and FIG. 8(*c*) are perspective views showing the manufacturing process of the ink jet head of the first embodiment.
Figure 8B:
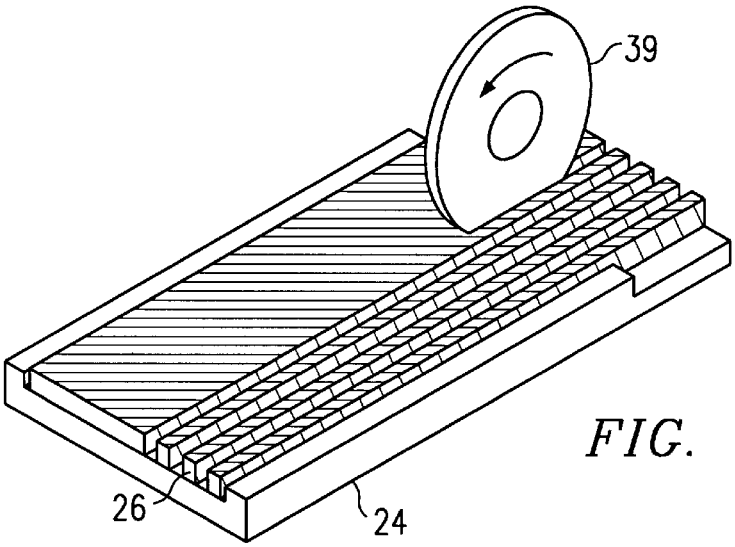
Figure 8C:
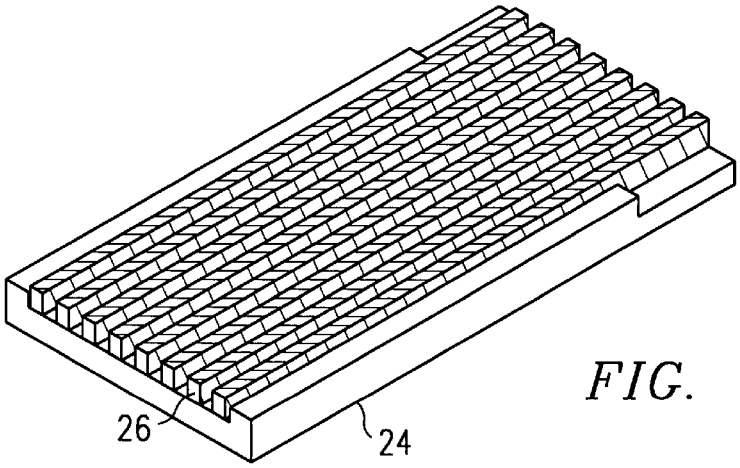

At first, as shown in FIG. 8(*a*), electrode layers are provided on the upper and lower surfaces of a PZT plate 40 which is the material of the piezoelectric bodies 26. Each of electrode layers is formed by means of a plating film of Au/Ni under no electrical field, or a sputtering film of Au/(Ni, Cr). The thickness of each of the electrode layers is preferably in a range of 0.1–10 $\mu$m. Then, the PZT plate 40 is attached to the bottom surface 25*a* of the concave portion of the substrate 24 using a conductive adhesive agent. For this case, the attachment region s is only on the rear edge (right in FIG. 8(*a*)) of the PZT plate 40 and the front edge is unattached.

Then, as shown in FIG. 8(*b*), the PZT plate 40 undergoes slit processing using an automatic dicing saw 39 and, as shown in FIG. 8(*c*), the piezoelectric bodies 26 are formed at a fixed pitch.

Thereafter, in order to prevent lowering of the displacement that occurs when a voltage is applied to the piezoelectric body 26 due to penetration of moisture in the atmosphere, a polyimide resin, for example, is applied to the entire surface of the piezoelectric body 26 using a spin coat method, baked for 1 hour at 180° C. and then undergoes an overcoat process. However, this process can be omitted when a piezoelectric material with a high humidity resistance is used in the piezoelectric body 26.

Figure 9A:
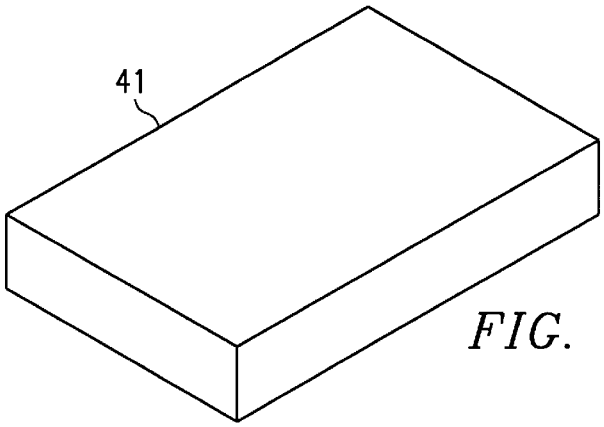
FIG. 9(*a*), FIG. 9(*b*) and FIG. 9(*c*) are perspective views showing the manufacturing process of the ink jet head of the first embodiment.
Figure 9B:
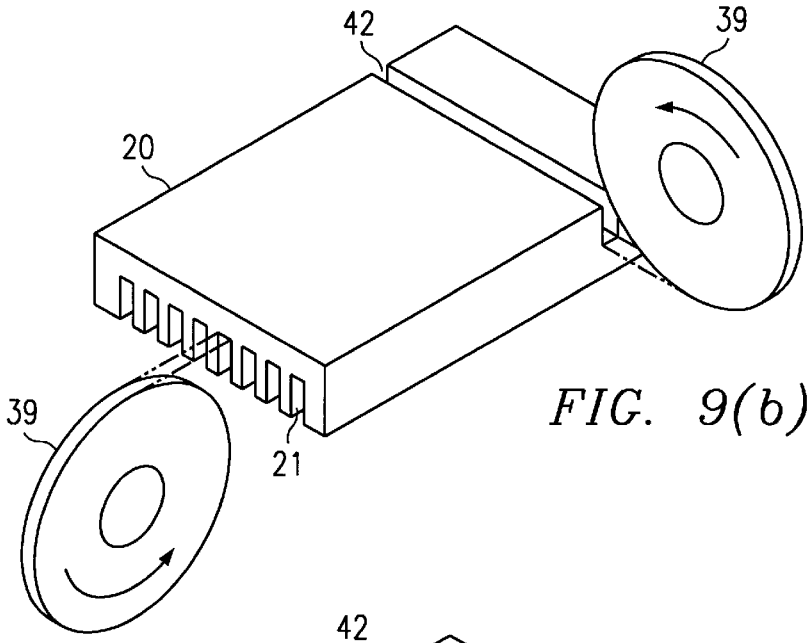
Figure 9C:
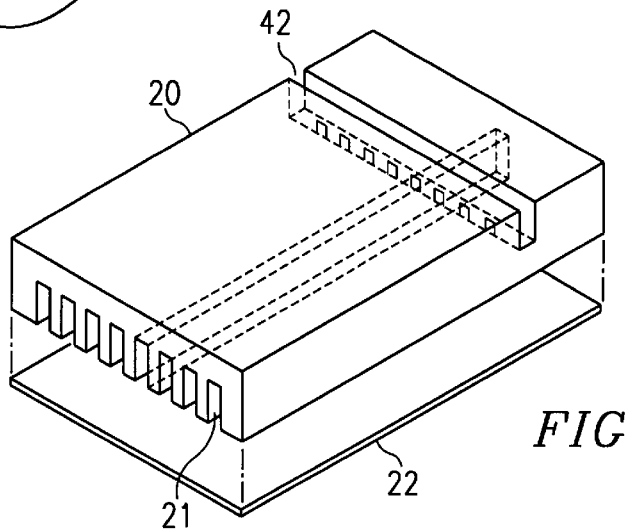

Conversely, as shown in FIG. 9(*a*) to FIG. 9(*c*), the top plate 20 uses, for example, a ceramic plate 41 such as alumina to form the plurality of concave portions 21 which become the ink chambers 23 using a dicing method at a pitch equal to the above-mentioned piezoelectric bodies 26. The width of these concave portions 21 is made larger than the piezoelectric body 26 so the piezoelectric body 26 can freely fit into it. Further, a channel-shaped ink inlet 42 is formed using a dicing saw on the surface opposite to the surface where these concave portions 21 form. This ink inlet 42 is at a right angle to the concave portion 21 as well as connects to all the concave portions 21. Thereafter, the partition 22 is attached to the surface on which the concave portion 21 of the top plate 20 is formed.

Figure 10A:
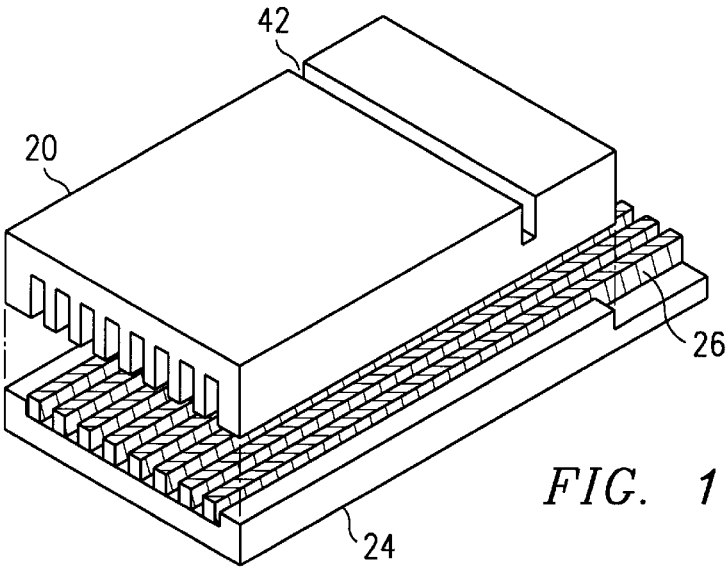
FIG. 10(*a*), FIG. 10(*b*) and FIG. 10(*c*) are perspective views showing the manufacturing process of the ink jet head of the first embodiment.
Figure 10B:
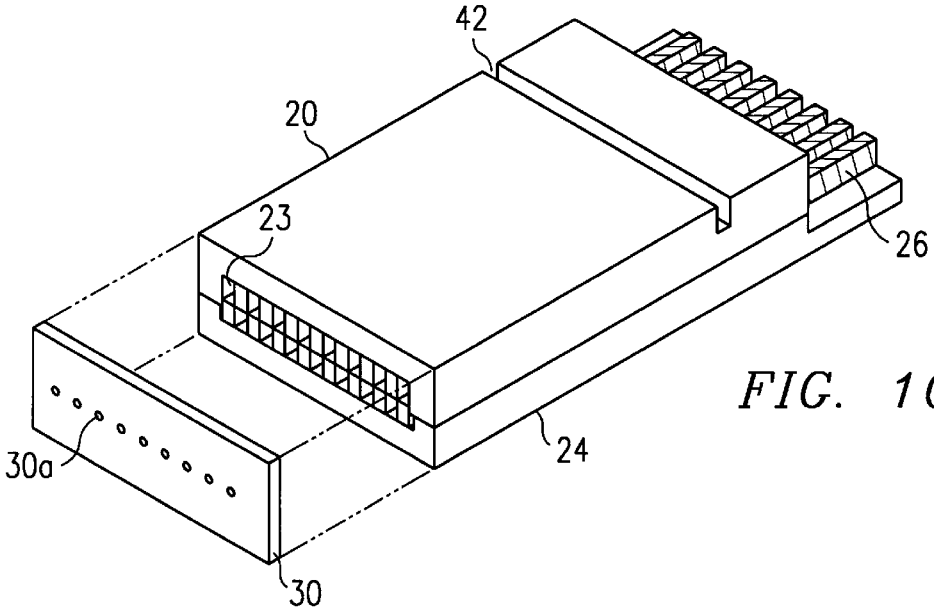
Figure 10C:
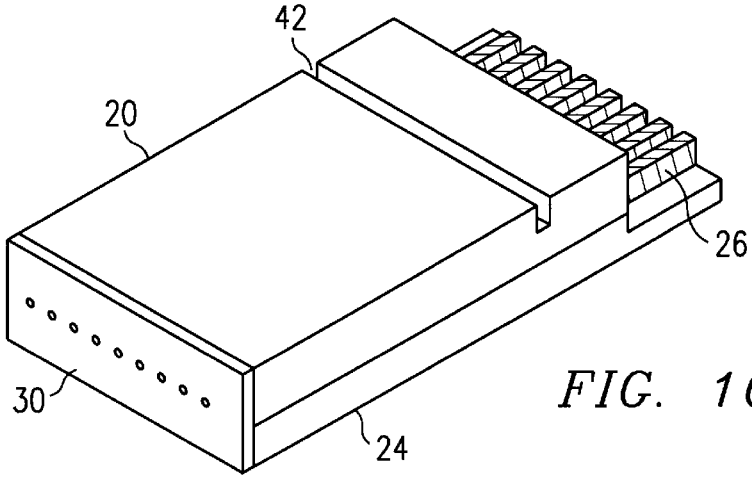

Continuing, as shown in FIG. 10 (*a*) to FIG. 10(*c*), the top plate 20 is stacked and matched on top of the substrate 24 and both ends in the axial direction are solidly attached along with the nozzle plate 30 attached to the front end surface of the integrated body of the top plate 20 and the substrate 24 so the nozzle hole 30*a* is positioned at the center of the ink chamber 23.

Figure 11A:
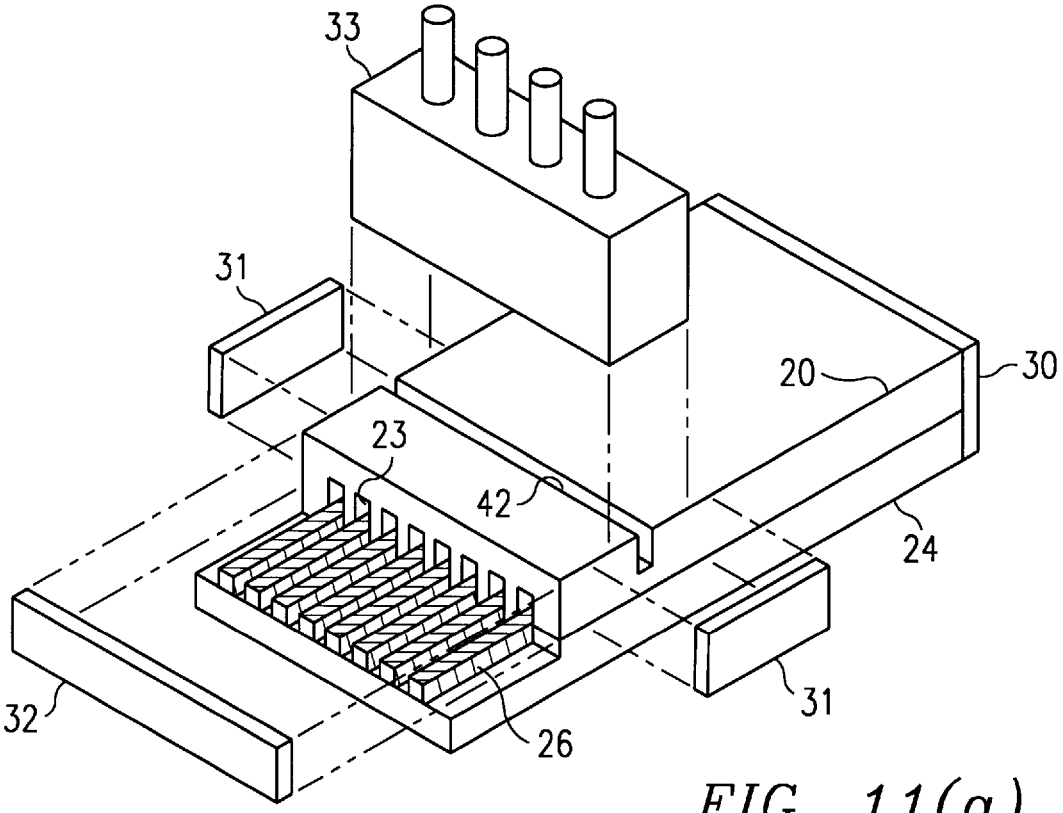
FIG. 11(*a*) and FIG. 11(*b*) are perspective views showing the manufacturing process of the ink jet head of the first embodiment.
Figure 11B:
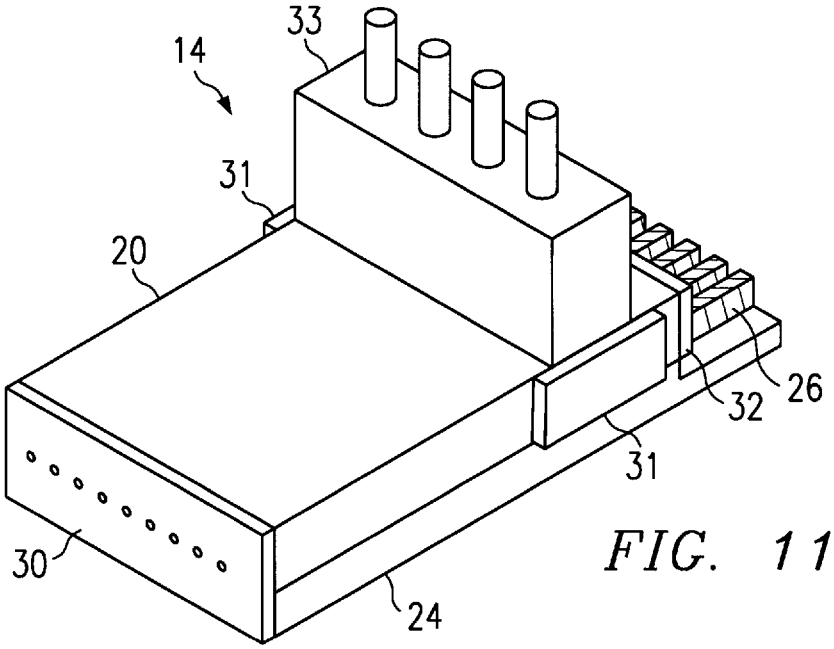

Then, as shown in FIG. 11(*a*) and FIG. 11(*b*), the assembly of the ink discharge portion 14 is completed by solidly attaching the manifold 33 to the top of the ink inlet 42 and attaching the side plates 31 which block the openings of both sides of the ink inlet 42 and the back plate 32 that blocks the rear end opening of the ink chamber 23 to the top plate 20.

Figure 12:
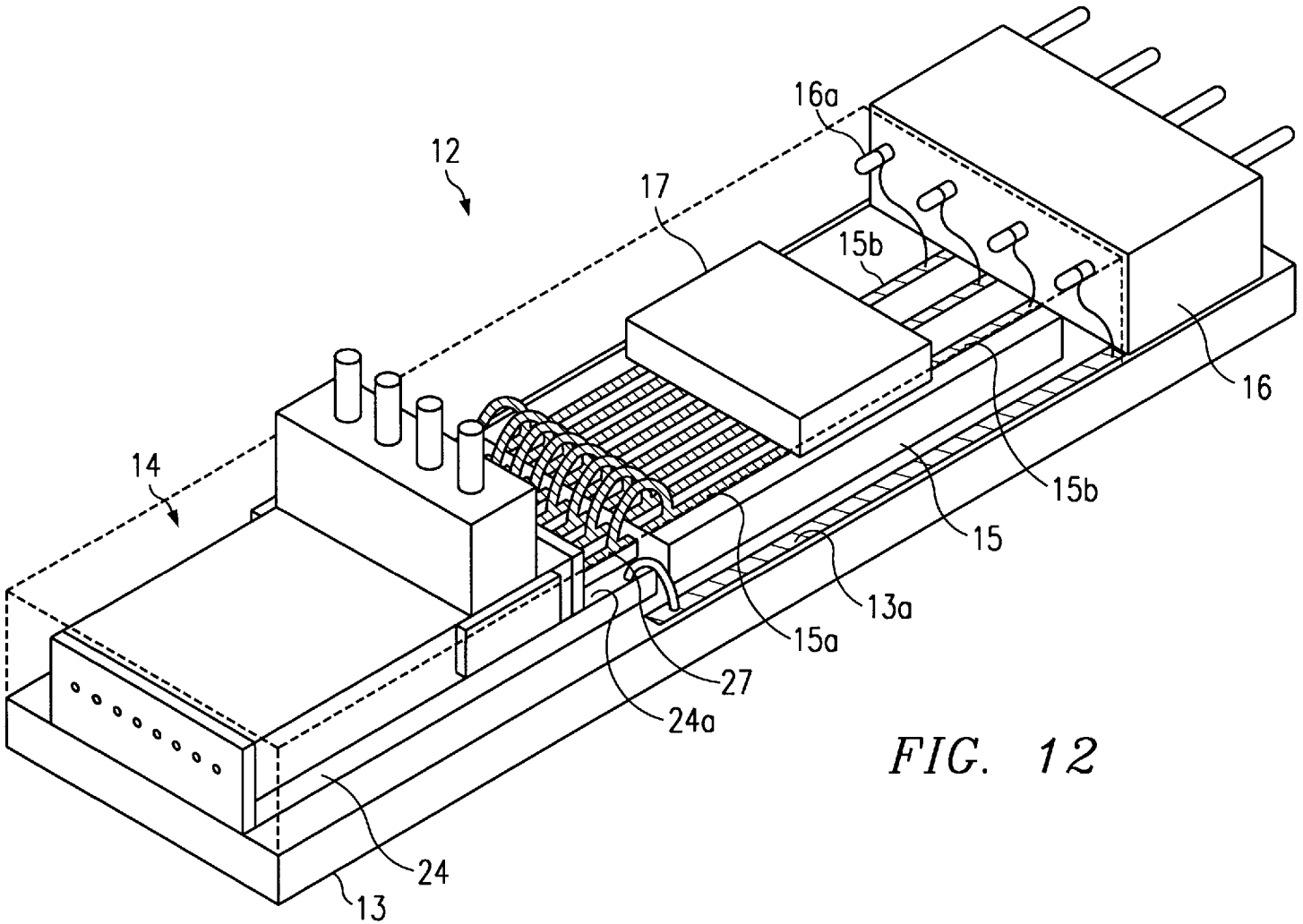
FIG. 12 is a perspective view showing the manufacturing process of the ink jet head of the first embodiment.
Figure 13A:
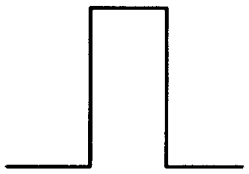
FIG. 13(*a*) to FIG. 13(*g*) show pulse waveforms of voltage applied to the piezoelectric body.
Figure 13B:
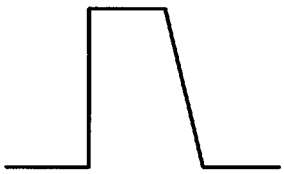
Figure 13C:
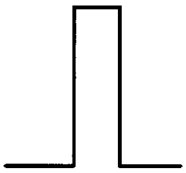
Figure 13D:
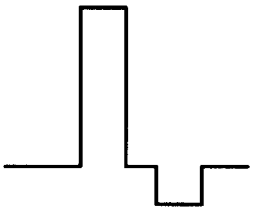
Figure 13E:
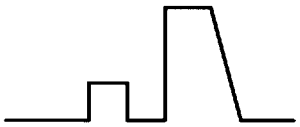
Figure 13F:
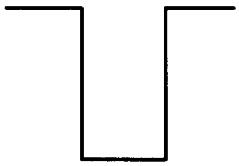
Figure 13G:
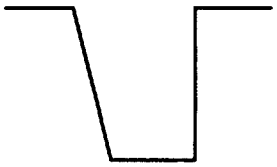

Further, as shown in FIG. 12, on the upper surface of the base plate 13 onto which is set the conductor 13*a* are solidly attached the above-mentioned ink discharge portion 14, the terminal plate 15 onto which is set a drive IC 17 and the conductors 15*a*, 15*b* as well as the connector 16. Then, the ink jet head 12 is completed by electrically connecting the individual electrode 27 of the piezoelectric body 26 to the conductor 15*a*, the surface 24*a* of the rear end of the substrate 24 that conducts electricity to the common electrode 28 of each piezoelectric body 26 to the conductor 13*a* on the base plate 13, and each conductor 15*b*, 13*a* to the terminal 16*a* of the connector 16, respectively. Thereafter, as shown by the dotted lines in FIG. 12, if the external surface is resin molded integrally, it can be fixed more practically.

Next, the ink discharge operation in the ink jet head 12 of this embodiment will be described.

As shown in FIG. 7, the ink is supplied from the ink supply portion 7 (see FIG. 4) through the ink supply openings 33*a* of the manifold 33 and fills up the ink chamber 23 inside the top plate 20. When a voltage pulse (as shown in FIG. 13 (*a*)) is applied across the individual electrode 27 and the common electrode 28 in response to an image signal, an electric field is formed with a parallel polarization direction (direction of arrow b in FIG. 15 and FIG. 16) in the piezoelectric body 26.

Figure 14:
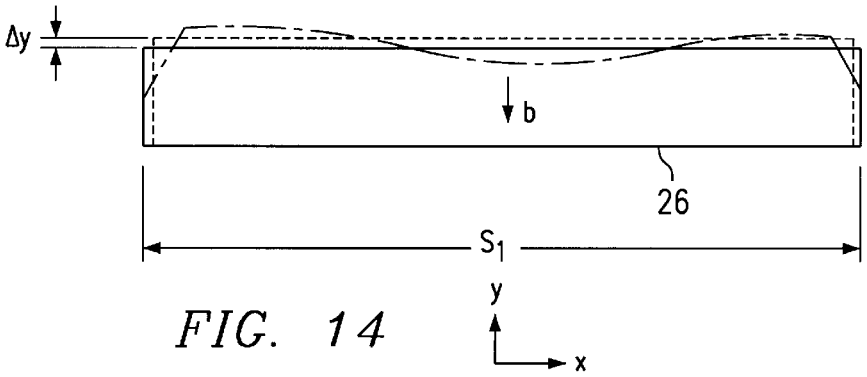
FIG. 14 is a side view showing the displacement of a piezoelectric body in a conventional ink jet head.

At this moment, if the piezoelectric body 26 is not solidly attached to the substrate 24 at all, the piezoelectric body will expand in the y direction by only $\Delta y$ as shown by the dotted lines in FIG. 14 along with a slight contraction in the x direction and the depth direction (i.e., a direction orthogonal to the paper plane in FIG. 14). However, in like manner to a conventional ink jet head, when the entire surface of the piezoelectric body 26 is attached to the substrate 24, there was a phenomenon in which bending also occurred in the substrate 24 following deformation of the piezoelectric body 26 and, as shown by the dot-dash line in FIG. 14, the surface of the piezoelectric body 26 deformed such that the expanded area and the contracted area mixed and bulged resulting in a large loss of the deformation amount of the entire piezoelectric body required to discharge the ink.

Figure 15:
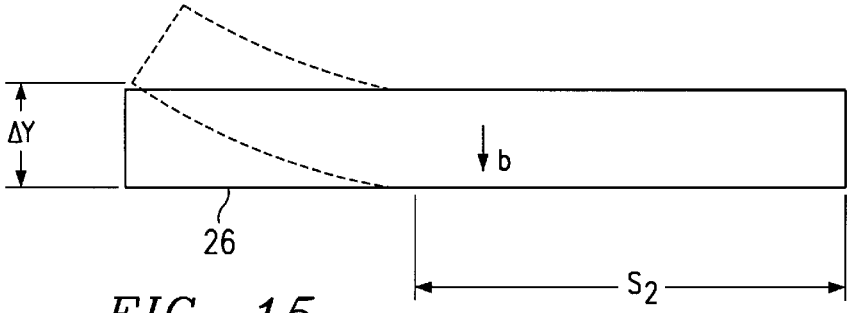
FIG. 15 is a side view showing the displacement of a piezoelectric body in the ink jet head of the first embodiment.

On the other hand, when one end of the piezoelectric body 26 is a free end in the form of one portion of the surface where the attachment region $S_2$ makes contact with the substrate 24 as in the construction of this embodiment, as shown by the dotted line in FIG. 15, the free end of the piezoelectric body 26 deforms such that the warping has a curvature in the direction that free end separates from the substrate. The displacement $\Delta Y$ of the y direction at that moment was confirmed to be larger compared to the above-mentioned $\Delta y$ when an identical voltage was applied.

Figure 16:
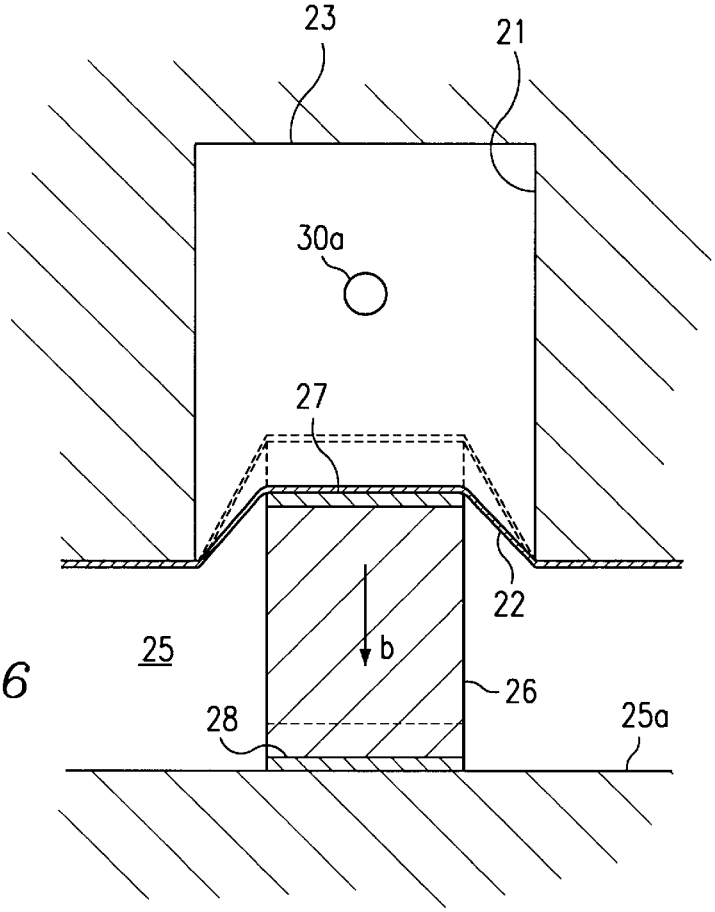
FIG. 16 is a partially enlarged view of the cross section shown in FIG. 6.

As shown in FIG. 16, the portion of the piezoelectric body 26 which is not fixed due to this warping deformation functions to sharply push the partition 22 into the concave portion 21 which reduces the capacity of the ink chamber 23. This change in capacity discharges and propels the pressurized ink in a fluid droplet shape from the nozzle hole 30*a* which then adheres to the surface of the recording paper (not shown in figure).

If the voltage between the individual electrode 27 and the common electrode 28 drops to 0 (zero), the piezoelectric body 26 returns to its original state. At this moment, the partition 22 is pushed into the ink chamber 23 by the piezoelectric body 26 which has elasticity and is shallowly fit in the concave portion 21 in the initial state thus, following the piezoelectric body 26 that will carry out the restoration operation while always making contact with it. This action can increase the capacity of the ink chamber 23 and supply ink to the ink chamber 23 via the manifold 33 and ink inlet 42 and the next ink discharge is prepared.

However, as shown in FIG. 13(*a*), during the above-mentioned ink supply, when the piezoelectric body is restored based on the elasticity of the piezoelectric body 26 by dropping the voltage to 0 (zero) instantly and the capacity of the ink chamber 23 is sharply increased, air may be sucked from the nozzle hole 30*a* and bubbles form inside the ink chamber 23. This results in the possibility that the bubbles may absorb the pressure when the subsequent voltage pulse is applied interfering with the propelling of the ink. Therefore, as shown in FIG. 13 (*b*), the shape of the voltage pulse when the piezoelectric body 26 carries out the restoration operation is given a slant in order that the piezoelectric body 26 and the partition 22 return as fast as possible within a range in which absorption of the bubbles does not occur to prevent this interference.

Further, in contrast with FIG. 13(*a*), if a voltage pulse with an altered pulse width is applied at the same voltage, the diameter of the ink droplets to be discharged can be altered thereby changing the diameter of the dots which will adhere to the recording paper. Therefore, allowing the reproduction of halftones. For example, as shown in FIG. 13(*c*), if the pulse width is made smaller, the dot diameter becomes smaller.

The voltage pulse shown in FIG. 13(*d*) is the one the subsequent pulse of the smaller voltage is applied to the main pulse at an opposite polarity. If a voltage pulse having this waveform is applied to the piezoelectric body 26, the ink column extending from the nozzle hole 30*a* after the ink droplet is discharged by the main pulse is drawn into the ink chamber 23 by means of the sub-pulse thereby allowing reductions in satellite noise.

The voltage pulse shown in FIG. 13(*e*) is the one the previous pulse of the smaller voltage is applied to the main pulse at an identical polarity. And, the voltage value of the main pulse can be held low under a voltage pulse having this waveform thereby making the load on the driver smaller. Therefore, the cost of the driver can be reduced.

One line of an image is drawn by independently carrying out the above-mentioned type of ink discharge operation for each ink chamber 23 in response to image signals. By repeatedly forming one line of an image in synchronization with the movement of the recording paper, the image is drawn on the recording paper in response to image signals.

In this way, by making the region $S_2$ where the piezoelectric body 26 and the substrate 24 attach one portion with respect to the entire length of the piezoelectric body 26 in the ink jet head 12 of this embodiment, coupled displacement caused by vibrations of the piezoelectric body 26 which occur when voltage is applied propagating to the adjacent piezoelectric body 26 via the substrate 24 can be completely suppressed. Therefore, there also is no needless ink discharge due to cross talk or irregularity in the ink flow inside the ink chamber 32 allowing extremely stable ink discharge and, as a result, making it possible to improve the printing quality by a remarkable degree.

Furthermore, by attaching one portion of the piezoelectric body 26, an extremely large amount of displacement can be obtained at an identical voltage compared to a conventional example and, the relationship exists in which the amount of displacement is almost in proportion to the applied voltage. Therefore, a very low voltage is sufficient to ensure a discharge quantity of ink and the ink propulsion speed identical to a conventional head as well. This enables lowering the cost of the driver, along with that the diameter of the ink droplets to be propelled can be freely changed by means of controlling the applied voltage using the voltage value, pulse width or a combination of these to adjust the amount of displacement of the piezoelectric body 26. There through, for the color of the image drawn on the recording paper, the reproduction of halftones becomes possible.

By fitting the piezoelectric body 26 into the concave portion 21 of the top plate 20, the partition 22 is bent and pressed inside the ink chamber 23. Consequently, because it is used to reliably reduce the capacity of the ink chamber 23 without any loss of the displacement of the piezoelectric body 26, highly efficient ink propulsion is achieved. Moreover, the partition 22 follows deformations of the piezoelectric body 26 while always maintaining contact with it. Therefore, high frequency response characteristics can be improved thereby, allowing increased printing speed.

Then, the piezoelectric body 26 is separated from the ink chamber 23 by the partition 22 so it does not make direct contact with the ink. Thus, the ink does not penetrate into the piezoelectric body 26 lowering the resistance. Therefore, reductions in the displacement of the piezoelectric body 26 following drops in the effective voltage can be prevented and, as a result, improving the stability and reliability of the ink jet head 12.

Figure 17:
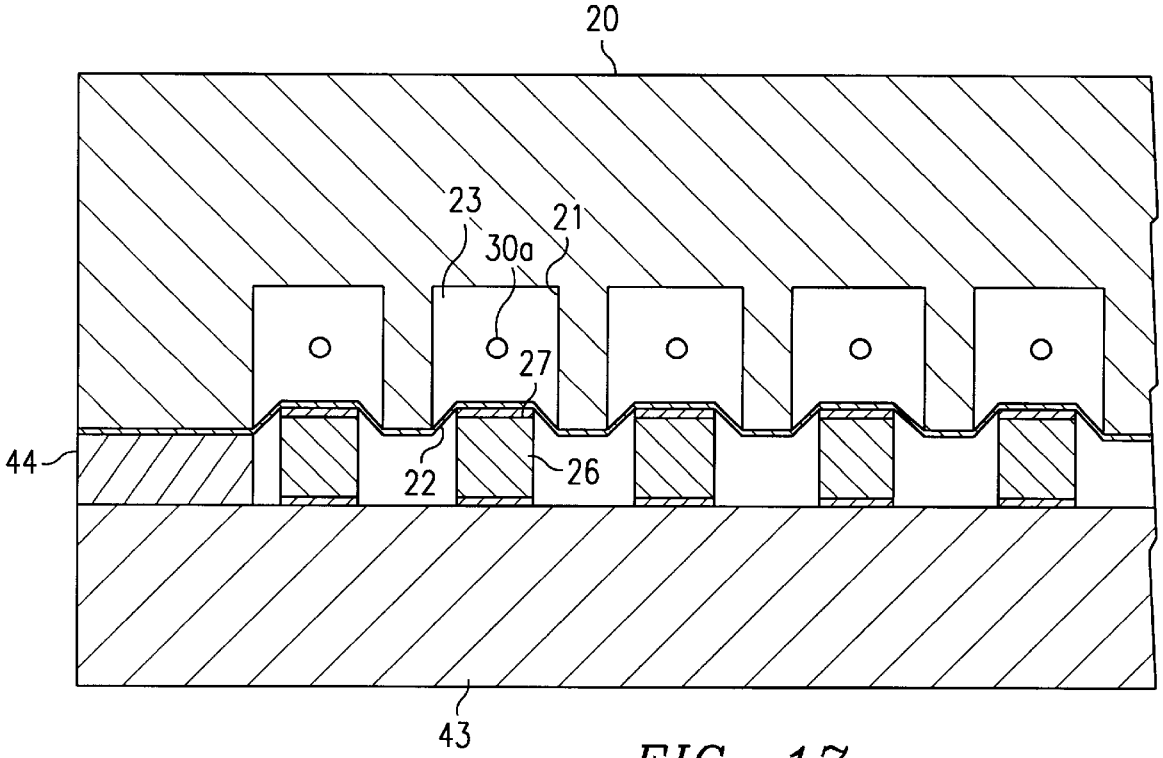
FIG. 17 is a crosswise sectional view of the principal parts of the ink jet head of a modified embodiment of the first embodiment.
Figure 18:
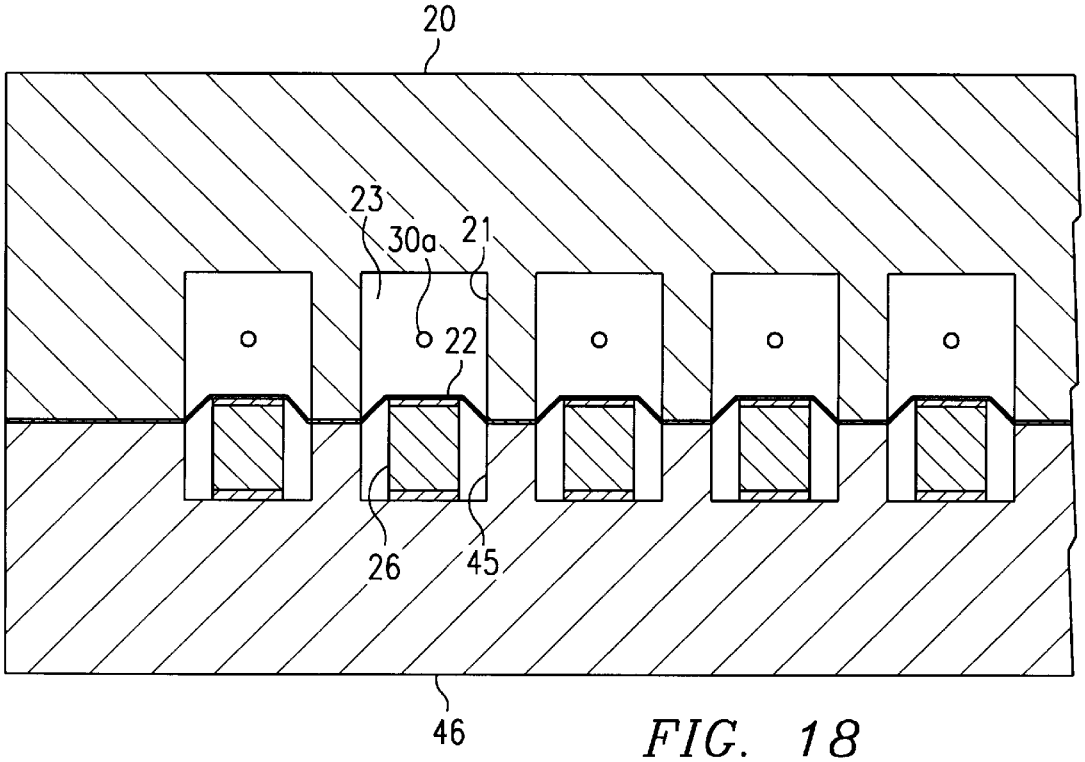
FIG. 18 is a crosswise sectional view of the principal parts of the ink jet head of another modified embodiment of the first embodiment.

Continuing, a modified embodiment of the above-mentioned first embodiment is described referring to FIG. 17 and FIG. 18.

In the ink jet head 12 of the first embodiment, although a substrate 24 in which a concave portion 25 is formed is used, as shown in FIG. 17, a substrate 43 with a flat upper surface can be used and spacers 44, 44 (one side not shown in figure) can be each arranged at both ends of this substrate. If constructed in this way, it is not necessary to provide the substrate 43 with a special shape making the formation simple and lowering the cost.

Further, as shown in FIG. 18, if the construction is such that a substrate 46 is used in which a concave portion 45 with an identical width with the above-mentioned concave portion 21 and with a depth shallower than the height of the piezoelectric body 26 is each formed at a position opposite to the concave portion 21 of the top plate 20, the partition 22 is gripped from the upper and lower direction and is divided at every ink chamber 23. Thus, the vibrations of the partition 22 which propagate to adjacent ink chambers 23 can be blocked even more appropriately.

Moreover, in the above-mentioned first embodiment and the modified embodiments, applying the voltage pulses shown in FIG. 13(*a*) to FIG. 13(*e*) causes the portion of the piezoelectric body 26 which is not fixed to function to displace the partition 22 in a direction separating from the substrate 24 which propels the ink, after which the ink is replenished when restoring the piezoelectric body 26. However, in contrast to this, the ink can be propelled when restoring the piezoelectric body 26 after applying the voltage pulse shown in either FIG. 13(*f*) or FIG. 13(*g*) to displace the partition 22 in a direction towards the substrate 24 by the function of the portion of the piezoelectric body 26 which is not fixed and then replenishing the ink. Hereupon, the reason the rising portion of the pulse in FIG. 13(*g*) is slanted is identical to the above-mentioned case of FIG. 13(*b*).

[Second Embodiment]

Figure 19:
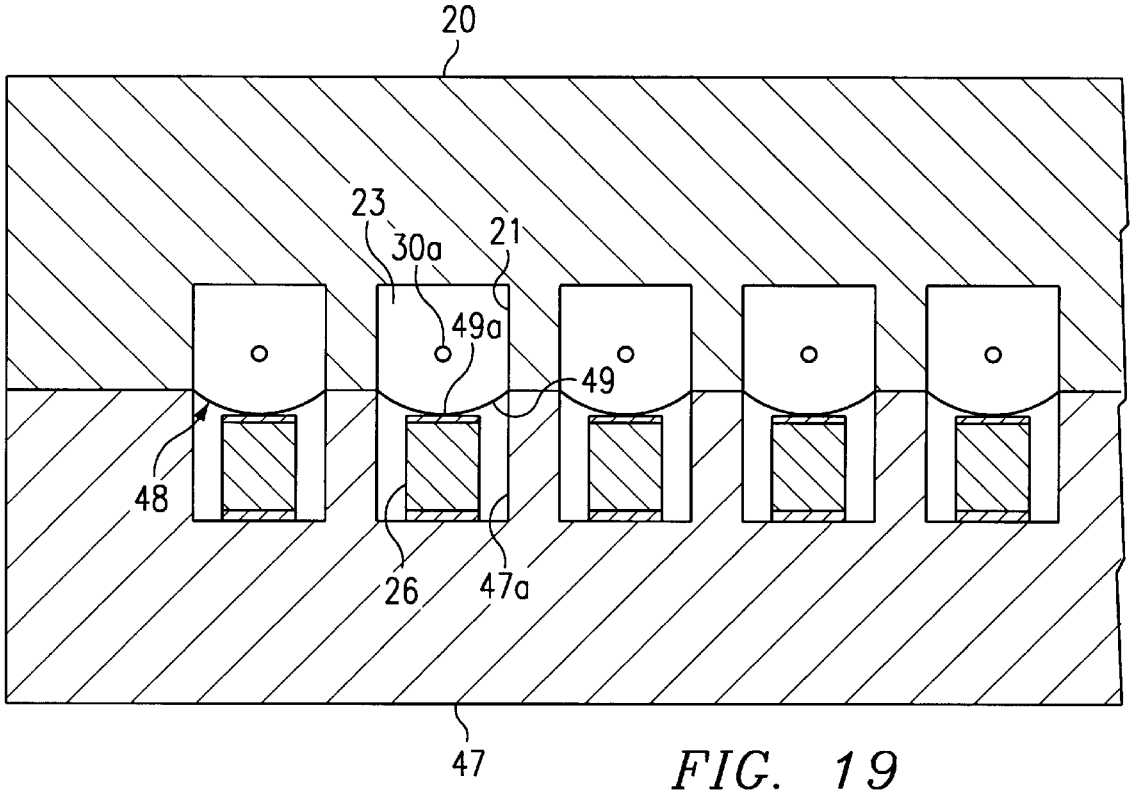
FIG. 19 is a crosswise sectional view of the principal parts of the ink jet head of the second embodiment.
Figure 20:
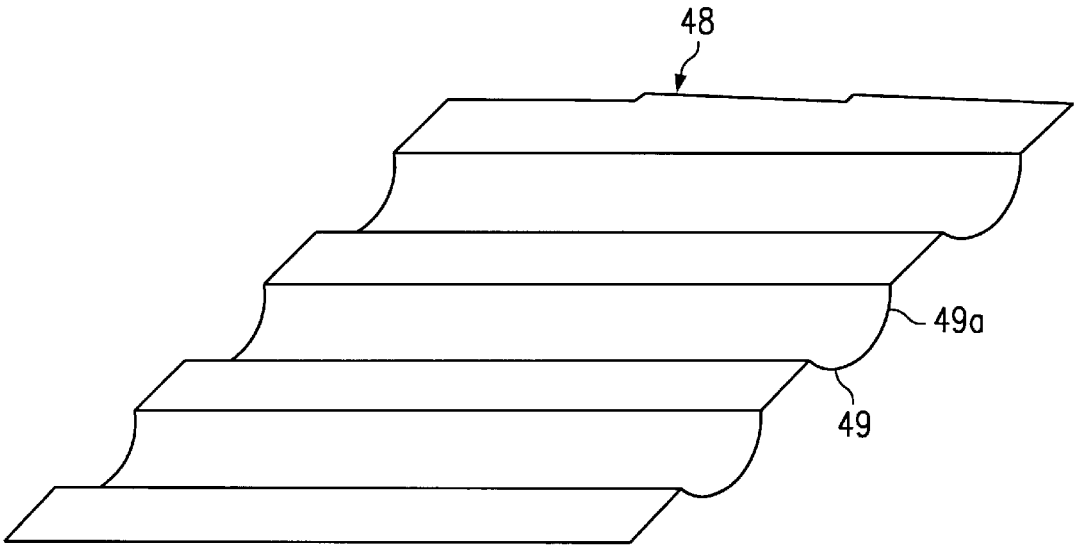
FIG. 20 is an overall perspective view of a partition of the ink jet head of the second embodiment.
Figure 21:
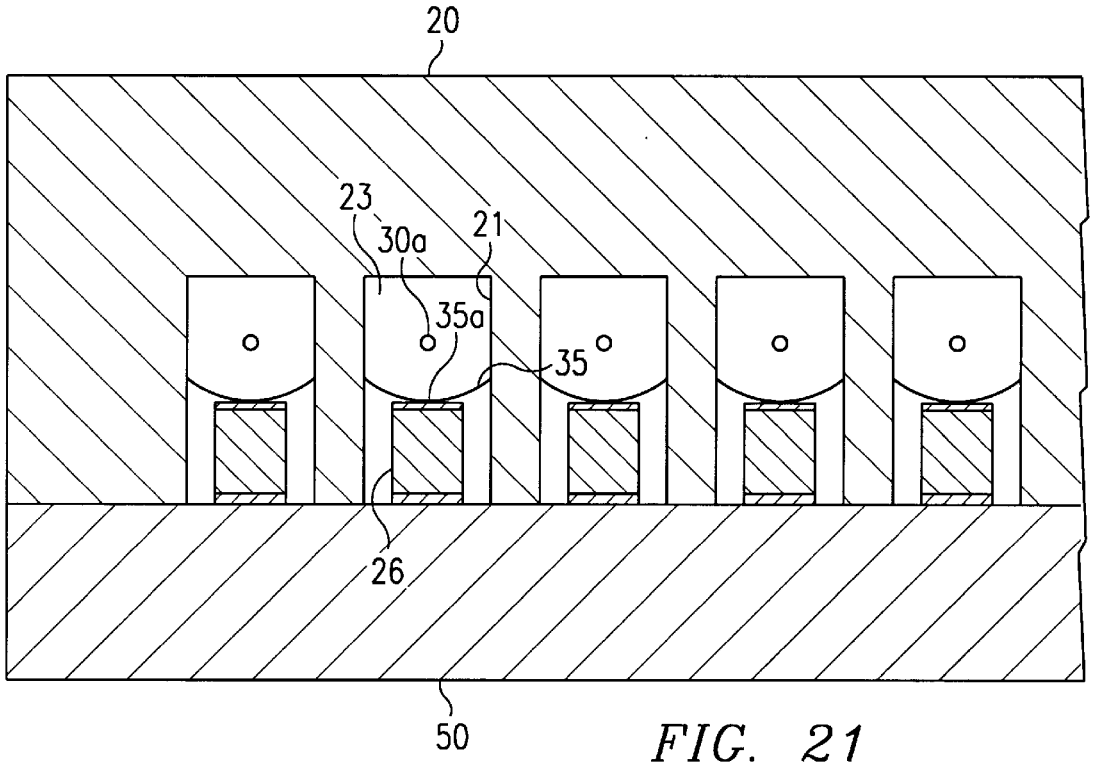
FIG. 21 is a crosswise sectional view of the principal parts of the ink jet head of a modified embodiment of the second embodiment.
Figure 22:
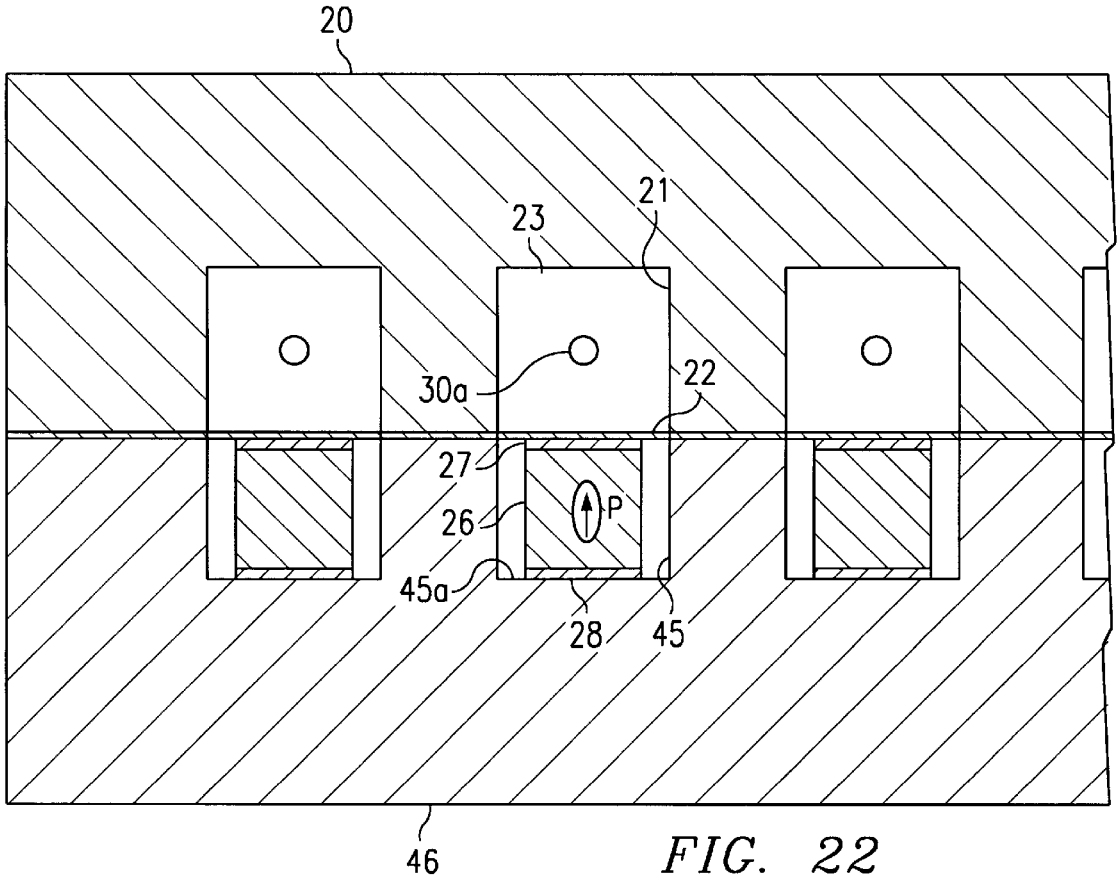
FIG. 22 is a crosswise sectional view of the ink jet head of the third embodiment.

Next, the ink jet head of a second embodiment of the present invention is described referring to FIG. 19 to FIG. 21.

As shown in FIG. 19, the ink discharge portion in the ink jet head of this embodiment is mainly comprised by a top plate 20 formed by a plurality of channel-shaped concave portions 21 at a fixed pitch, a substrate 47 formed by concave portions 47*a* each of which has the same width as the concave portion 21 at positions corresponding to these concave portions 21, a piezoelectric body 26 of which one portion is attached to the substrate 47 in like manner to the above-mention ed first embodiment on the bottom surface of these concave portions 47*a*, and a partition 48 arranged between the top plate 20 and the substrate 47 which forms an ink chamber 23 between itself and the above-mentioned concave portion 21 side wall. As shown in FIG. 20, on this partition 48 a plurality of channel portions 49 are formed along each concave portion 21 by means of either a press forming or film insert forming of the partition 48. The cross section of these channel portions 49 swell in a circular arc shape toward the bottom surface of the above-mentioned concave portions 47*a*. When the channel portions 49 are assembled, the bottom portion 49*a* of the channel portions 49 are brought into contact with the top portion of the piezoelectric body 26. Moreover, because the construction other than the above-mentioned is identical to the first embodiment, their descriptions are omitted.

Besides obtaining results similar to the first embodiment, the ink jet head of the second embodiment comprising the above-mentioned construction has a shape in which the channel portions 49 are swelling thus, increasing the speed of the restoration after they are pressed in. Consequently, the following properties toward the piezoelectric body 26 that vibrates at a high frequency can be improved and the printing speed increased. Further, if the bottom portion 49*a* of the above-mentioned channel portion 49 is adhered to the piezoelectric body 26, both the high frequency response characteristics can be improved and the printing speed increased even more.

As further shown in FIG. 21, as a modified embodiment of the second embodiment, the construction can be such that the concave portion 21 of the top plate 20 forms deeper than the one of the above-mention ed second embodiment along with a partition 35 which is integrally formed with the top plate 20 inside this concave portion 21 forming for each concave portion 21, the top plate 20 and the substrate 50 are stacked and fixed on top of one another in a state in which the concave portion 21 is completely fitted in the piezoelectric body 26 arranged on the flat substrate 50, and the bottom portion 35*a* of the partition 35 is brought into contact with the top portion of the piezoelectric body 26. With this modified embodiment as well, not only can results similar to the second embodiment be obtained but also parts used in processing are substantially reduced. Thus, lower costs can be achieved due to reduced processing. Moreover, the partition 35 for this case is integrally formed using material similar to the top plate 20 by means of resin forming.

[Third Embodiment]

A third embodiment of the present invention is described below referring to FIG. 22 to FIG. 27. As shown in the crosswise sectional view of FIG. 22, the cross-sectional shapes of the top plate 20 and the substrate 46 of the ink jet head of the third embodiment are identical to the modified embodiment of the first embodiment described in FIG. 18, except that the height of the piezoelectric body 26 are almost identical to the depth of the concave portion 45 formed on the substrate 46. Further, as shown in the side sectional view of FIG. 23, the arrangement of the electrodes formed on the piezoelectric body 26 and the mounting method of the piezoelectric body to the substrate 46 are different.

Concretely, because the height of the piezoelectric body 26 is almost identical to the depth of the concave portion 45 formed on the substrate 46, the piezoelectric body 26 makes contact with the partition 22 while maintaining the partition 22 in a nearly perfect plane. The common electrode 27 is formed on the surface where this piezoelectric body 26 and partition 22 make contact. However, as described later, the common electrode 27 is not formed on the region behind the piezoelectric body 26 corresponding to the portion attached to the substrate 46. Conversely, the individual electrode 28 is formed across the entire lower surface of the piezoelectric body 26 that makes contact with the bottom surface 45*a* of the channel portion 45 of the substrate 46. Moreover, the piezoelectric body 26 undergoes a polarization process in the direction (direction of arrow P) from the individual electrode 28 toward the common electrode 27.

Furthermore, in order to prevent lowering of the amount of displacement that occurs when a voltage is applied to the piezoelectric body 26 due to penetration of moisture in the atmosphere, it is preferable for a polyimide resin, for example, is applied to the surface of the piezoelectric body 26 using a spin coat method, baked for 1 hour at 180° C. and then undergoes an overcoat process. However, this process can be omitted when a piezoelectric material with a high humidity resistance is used in the piezoelectric body 26.

Figure 23:
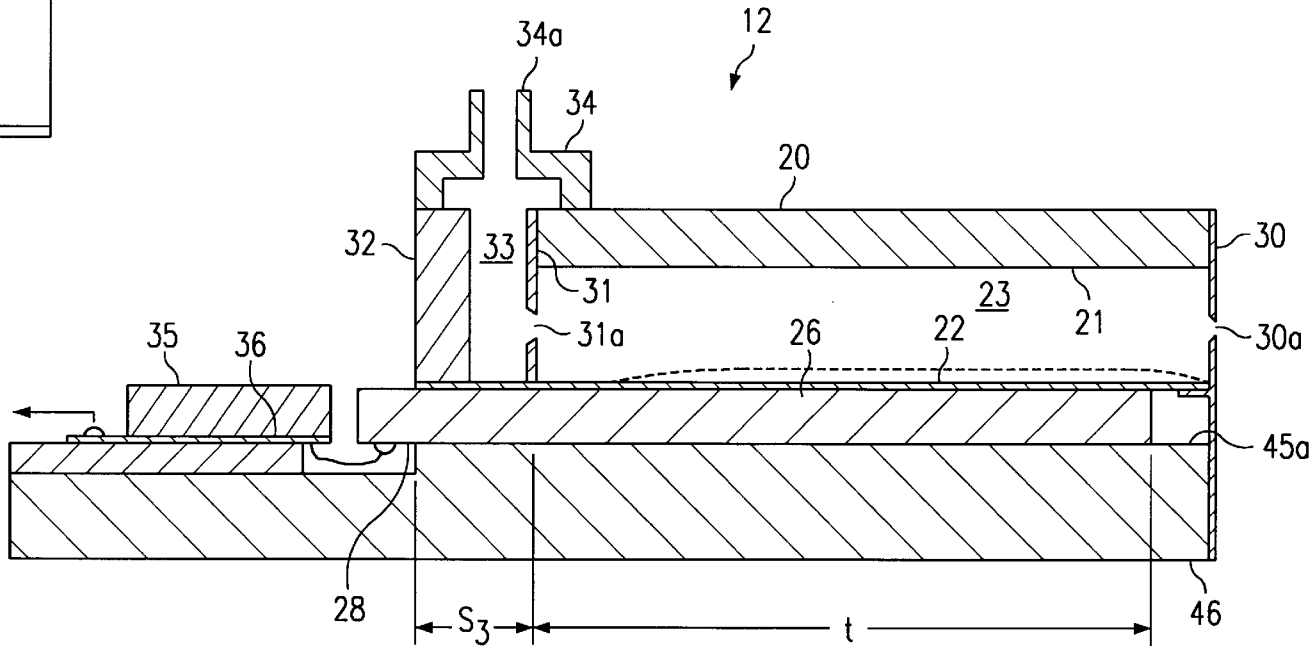
FIG. 23 is a lengthwise sectional view of the ink jet head of the third embodiment.

As shown in FIG. 23, the above-mentioned piezoelectric body 26 is attached to the bottom surface 45*a* of the above-mentioned channel portion 45 with an adhesive material at rear region S3 (hereinafter referred to as "attachment portion"). The piezoelectric body 26 is not solidly attached to the substrate 46 and to partition 22 at region t (hereinafter referred to as "functional portion") which corresponds to at least an ink chamber 23 positioned further in front than this attachment portion S3 but is mechanically held between the partition 22 and the bottom surface 45*a* of the above-mentioned channel portion 45. Further, the common electrode 27 and the discrete electrode 28 are respectively formed on the upper and lower surfaces of the functional portion t of the piezoelectric body 26. Only the individual electrode 28 is formed on the above-mentioned attachment portion S3 while the common electrode 27 is not formed. However, if the piezoelectric body 26 is sufficiently held by the substrate 46 and the partition 22, the attachment of the attachment portion S3 of the piezoelectric body 26 to the substrate can be omitted.

As shown in FIG. 23, the above-mentioned piezoelectric body 26 protrudes toward the rear more than the back plate 32 and the individual electrode 28 on the lower surface of the protruding portion is supported on a leader line support member 35. Furthermore, each individual electrode 28 is connected to a leader line 36 that corresponds to each piezoelectric body 46 by means of wire bonding or similar method. This leader line 36 is connected to a controller 6 (see FIG. 4) which is a voltage application means via a drive IC (not shown in figure). Voltage is applied to the piezoelectric body 26 in response to image signals by means of this controller 6.

On the other hand, the common electrode 27 on the upper surface of the piezoelectric body 26 is electrically grounded. Although this connection to ground is not shown in the figure, it is performed by the following methods: for example, by forming the partition 22 from a resin or a metal which has electrical conductive properties or by forming an adhesive agent layer which provides electrical continuity to all the common electrodes 27 by attaching the partition 22 to each piezoelectric body 26 using a conductive adhesive agent to establish a ground at one location only on either this type of partition 22 or adhesive agent layer.

Continuing, the ink discharge operation of the ink jet head 12 comprising the above-mentioned construction is described.

As shown in FIG. 23, the ink is supplied from the ink supply portion 7 (see FIG. 4) to an ink tube 34*a* and fills up each ink chamber 23 via an ink distribution path 33.

Figure 24:
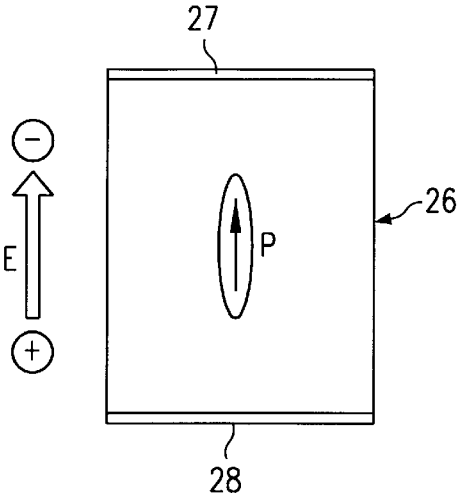
FIG. 24 shows the polarization direction and the electric field formation direction of the piezoelectric body of the third embodiment.

When a voltage pulse with a positive polarity is applied to the individual electrode 28 of the piezoelectric body 26, as shown in FIG. 24, an electric field is formed at the functional portion t of the piezoelectric body 26 in a direction (direction of arrow E) away from the individual electrode 28 to the common electrode 27 or, in other words, parallel to the polarization direction (direction of arrow P) and the piezoelectric body 26 deforms and vibrates in a thickness direction vibration mode.

Figure 25:
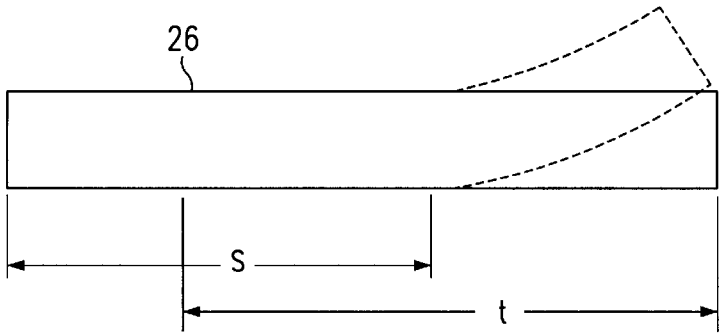
FIG. 25 shows a modified state when one portion of the piezoelectric body is attached.

At this moment, when one portion of the above-mentioned functional portion t is the attachment region $S_3$ and the front end is not attached, the front end bends as shown by the dotted lines in FIG. 25. However, because this deformation is not uniform, there is a possibility twisting may occur and if this occurs, the amount the partition 22 rises will differ for each piezoelectric body 26 resulting in the possibility that the diameter of the ink droplets to be propelled will not be uniform.

Figure 26:
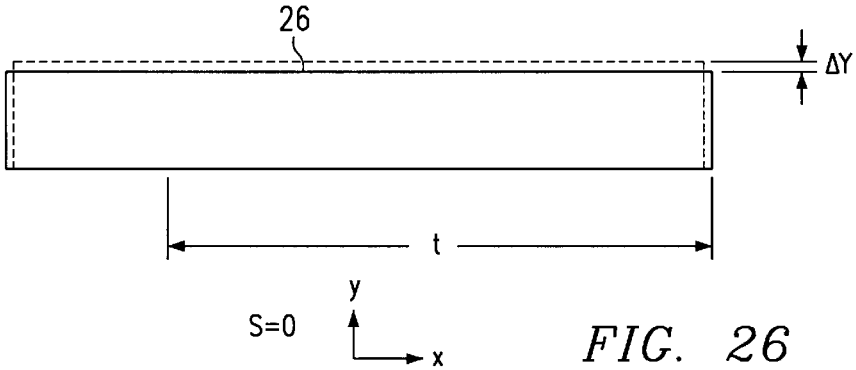
FIG. 26 shows a modified state when the piezoelectric body is not attached.

In contrast to this, when a voltage is applied without attaching the piezoelectric body 26 at all, swelling deformation occurs uniformly in the y direction as shown by the dotted lines in FIG. 26 by only Δy along with a slight contraction in the x direction and the lengthwise direction (i.e., a direction orthogonal to the paper plane in FIG. 26).

Because the common electrode 27 is not formed on the attachment portion S3 of the piezoelectric body 26 in this embodiment, an electric field is not formed inside and there is no deformation at this portion. Conversely, because the functional portion t of the piezoelectric body 26 is not solidly attached to the substrate 24 at all, deformation of the area close to the attachment portion S3 can be controlled although swelling deformation occurs uniformly in the y direction by only Δy at almost the entire region except this region.

By the functional portion t of the piezoelectric body 26 which deforms almost uniformly acting on the partition 22 in this way, the partition 22 is raised up sharply as shown by the dotted lines in FIG. 23 and reduces the capacity of the ink chamber 23. Thereby, the pressurized ink changes to a fluid droplet shape which is then discharged and propelled from the nozzle hole 30*a* to adhere to the surface of the recording paper (not shown in figure).

If the voltage applied to the individual electrode 27 drops to 0 (zero), the piezoelectric body 26 returns to its original state. At this moment, based on the elasticity of the partition 22, the partition 22 follows while always making contact with the piezoelectric body 26 that will be restored. This action can increase the capacity of the ink chamber 23 and supply ink to the ink chamber 23 via the manifold 34, ink distribution path 33 and the ink supply opening 31*a* while preparing for the next ink discharge. Moreover, any of the pulses shown in the previously described FIG. 13(*a*) to FIG. 13(*g*) can be used for the voltage pulse which drives the piezoelectric body 26 of this embodiment.

One line of an image is drawn by independently carrying out the above-mentioned type of ink discharge operation for each ink chamber 23 in response to image signals. By repeatedly forming one line of an image in synchronization with the movement of the recording paper, the image is drawn on the recording paper in response to image signals.

In this way, because the functional portion t of the piezoelectric body 26 is held between the partition 22 and the bottom surface 45*a* of the channel portion 45 formed on the substrate 46, without being attached solidly to the substrate 46 at all, vibrations of the functional portion t which occur when voltage is applied do not propagate to the adjacent piezoelectric body 26 via the substrate 46 allowing coupled displacement to be completely suppressed. Therefore, there also is no needless ink discharge due to cross talk or irregularity in the ink flow inside the ink chamber 32 allowing extremely stable ink discharge and, as a result, making it possible to stabilize the dot diameter without any unevenness between the dots of the ejected ink droplets as well as improving the printing quality by a remarkable degree.

Furthermore, the partition 22 presses against almost the entire region of the functional portion t without any unevenness in the amount of pushup force of the partition 22 as in the case when one portion of the functional portion t of the piezoelectric body 26 is attached to the substrate 46, thereby improving the stability of the ink propulsion.

Furthermore, because there is no attachment portion on the functional portion t of the piezoelectric body 26, there are no changes in the fixed state because of deterioration in the attachment due to vibrations of the functional portion t nor peeling of the piezoelectric body 26 from the substrate 46 as in the case when the entire surface or one portion of the functional portion t is attached to the substrate 46. Therefore, the life of the ink jet head can be lengthened and a stable deformation state of the piezoelectric body 26 can be obtained thereby improving the reliability of the ink propulsion.

In addition, because the piezoelectric body 26 is shielded from the ink chamber 23 by the partition 22 and does not make direct contact with the ink, the ink does not penetrate into the piezoelectric body 26 lowering the resistance. Therefore, reductions in the amount of deformation of the piezoelectric body 26 following drops in the effective voltage can be prevented as well as drops in the ink propulsion efficiency. As a result, improving the stability and reliability of the ink jet head 12.

Thus, the process is comparatively simple according to the construction of this embodiment thereby, allowing higher densities and multiple nozzles at low cost as well as higher printing speeds.

The above-mentioned attachment portion S3 of the piezoelectric body 26 does not deform because the common electrode 27 is not formed. However, it is allowable for deformation not to occur even though an electric field is formed by not carrying out a polarization process for the portion proportional to the attachment portion S3. Further, even if deformation occurs at the attachment portion S3, it is also allowable to absorb that deformation by using a pliable adhesive agent after drying as well in order that bending deformation does not occur on the functional portion t to avoid the ink propulsion from being affected.

Figure 27:
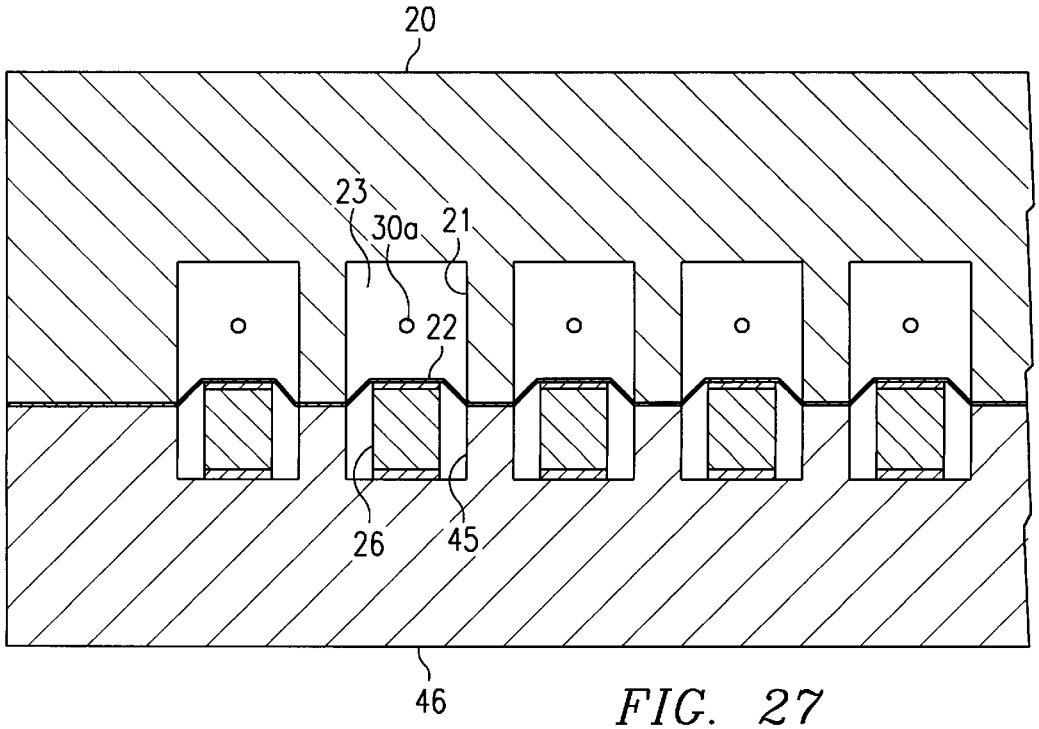
FIG. 27 shows a modified embodiment of the ink jet head of the third embodiment.

Moreover, in this embodiment, the height of the piezoelectric body 26 and the depth of the channel portion 45 of the substrate 46 form equally and the partition 22 makes contact with the piezoelectric body 26 while maintaining a flat plane state. However, as shown in FIG. 27, if the height of the piezoelectric body 26 forms slightly larger and the upper portion of the piezoelectric body 26 is shallowly fit along the concave portion 21 of the top plate 20 and the partition 22 is pressed into the inside of the ink chamber 23, high frequency response characteristics are improved similar to when the piezoelectric body 26 and the partition 22 are attached.

[Fourth Embodiment]

Figure 28:
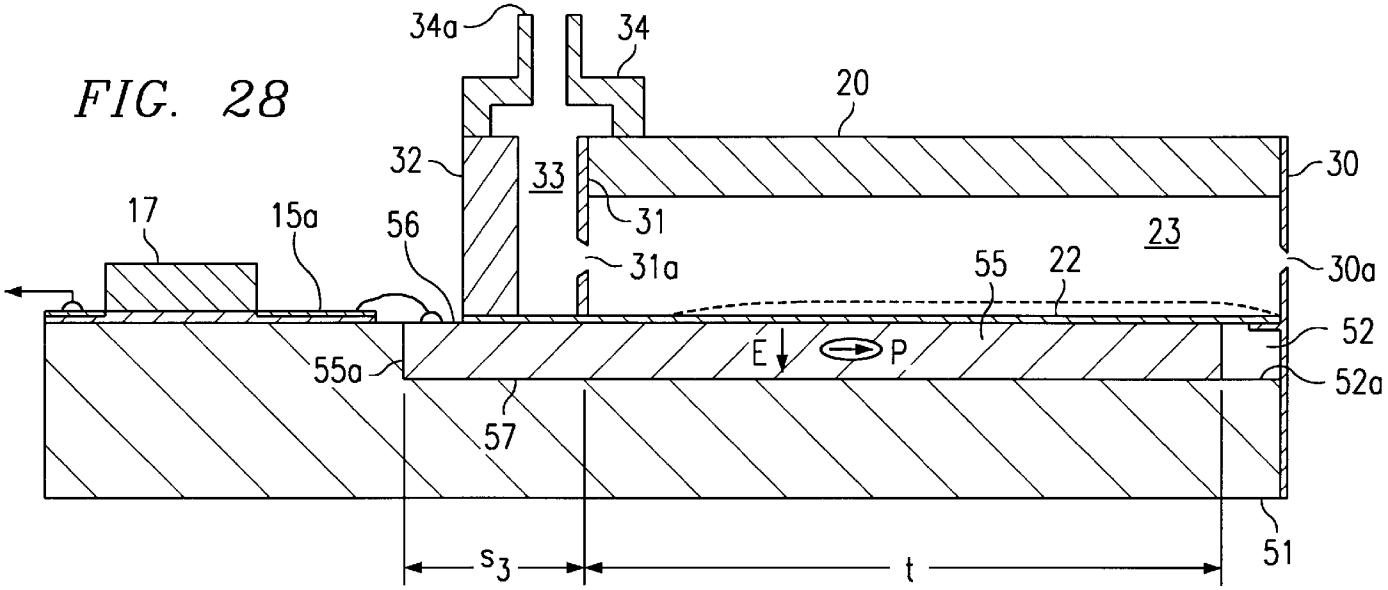
FIG. 28 is a lengthwise sectional view of the ink jet head of the fourth embodiment.
Figure 29:
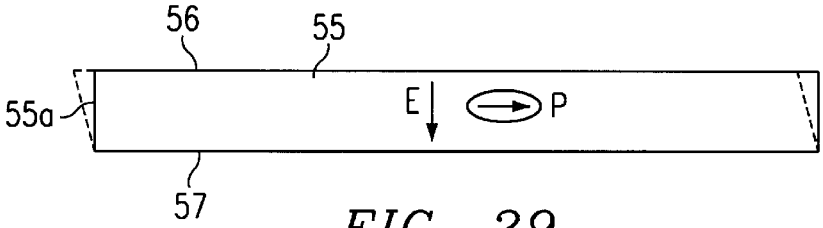
FIG. 29 is a modified state using an thickness shear vibration mode of a non-attached piezoelectric body.
Figure 30:
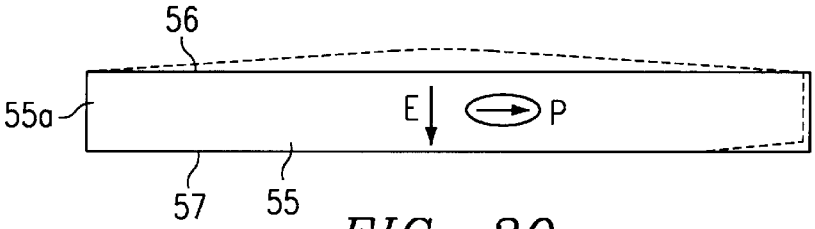
FIG. 30 is a modified state of the piezoelectric body of the fourth embodiment.

Although the ink jet head of a fourth embodiment is described referring to FIG. 28 to FIG. 30 next, items other than those specially mentioned are identical to the above-mentioned third embodiment thus identical portions use identical numbers and the description is omitted.

In like manner to the third embodiment, a plurality of channel portions 52 corresponding to the concave portions 21 formed on the top plate 20 are also formed on the substrate 51 of the ink jet head of this embodiment. However, as shown in FIG. 28, these channel portions 52 are closed at the rear end (left side in FIG. 28).

The piezoelectric body 55 is similar to the third embodiment in that it forms a long slender shaft-shaped bodies having a rectangular cross section with each arranged inside the above-mentioned channel portions 52. However, in this embodiment, the polarization process is carried out in a direction (direction of arrow P) away from the rear end of the piezoelectric body 55 toward the front end with the discrete electrode 56 arranged on the upper portion inside the channel portion 52 and the common electrode 57 arranged on the lower portion inside the channel portion 52. Then, the rear end 52*a* of the channel portion makes contact with the rear wall of the channel portion 52 without any space and is fixed to the substrate 51 by means of attachment portion S3.

The above-mentioned individual electrode 56 is connected to a leader line 15*a* by means of a wire bonding method and then is connected to the controller 6 (see FIG. 4) via the drive IC 17. Conversely, the common electrode 57 is formed crossing over the entire length of the piezoelectric body 55 and is electrically grounded by means of a conductive adhesive agent layer (not shown in figure) which provides electrical continuity to the common electrodes 57 of each piezoelectric body 55.

When a voltage pulse with a positive polarity is applied to the individual electrode 56 of the above-mentioned piezoelectric body 55, an electric field is formed inside the piezoelectric body 55 in a direction (direction of arrow E) at a right angle to the polarization direction and, the piezoelectric body 55 deforms due to shearing along the surface where the electrode is formed and vibrates by the thickness shear vibration mode. When the piezoelectric body 55 can freely deform, as shown by the dotted lines in FIG. 29, the shape of the side of the rectangle of the piezoelectric body 55 deforms due to shearing to a parallel quadrilateral when voltage is applied. However, in this embodiment, because the piezoelectric body 55 is fixed at the attachment portion S3 and the rear end 55*a* of the body 55 makes contact with the attachment portion S3, free deformation of the piezoelectric body 55 is restricted and, as shown by the dotted lines in FIG. 30, the surface where the discrete electrode 48 is formed curves and swells mainly at the functional portion t of the piezoelectric body 55 along with the surface close to the front end where the common electrode 57 is formed curving and rising up from the substrate 51 with the side of the entire piezoelectric body 55 deforming into a barrel shape.

As shown by the dotted lines in FIG. 28, the partition 22 is pressed up and the capacity of the ink chamber 23 reduced by the functional portion t of the piezoelectric body 55 that deforms acting on the partition 22 as stated above. This change in capacity works to propel the pressurized ink from the nozzle hole 30*a* in a fluid droplet shape. When the application of voltage is released, the piezoelectric body 55 returns to its original state and ink chamber 23 is replenished with ink.

Thus, using the thickness shear vibration mode for the deformation and vibration of the piezoelectric body 55 for the ink jet head of this embodiment, the volume of deformation grows due to a shearing stress being applied that increases the stress compared to when the thickness direction vibration mode is used as in the third embodiment. This allows drive at a low voltage. Therefore, according to this embodiment, other than obtaining results similar to the third embodiment, results obtained such as reducing the cost of the driver and achieving highly efficient ink propulsion.

Figure 31:
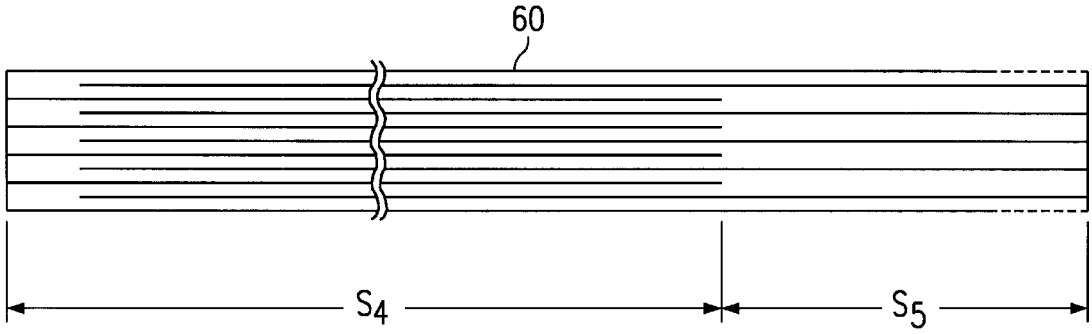
FIG. 31 is a side view of a layered type piezoelectric body that can be applied to the above-mentioned embodiment and its modified embodiment.

In the above-mentioned first to fourth embodiments and their modified embodiments described above, although single layer piezoelectric bodies 26, 55 were used, as shown in FIG. 31, if a layered type piezoelectric body 60 is used in which two or more layers of multi-layer piezoelectric material are laminated by means of the well-known green sheet method and an individual electrode and a common electrode are arranged is used, it is possible to obtain a large effective displacement in proportion to the number of layers thereby, allowing the drive voltage to be lowered and reducing the cost of the driver.

[Fifth Embodiment]

Figure 32:
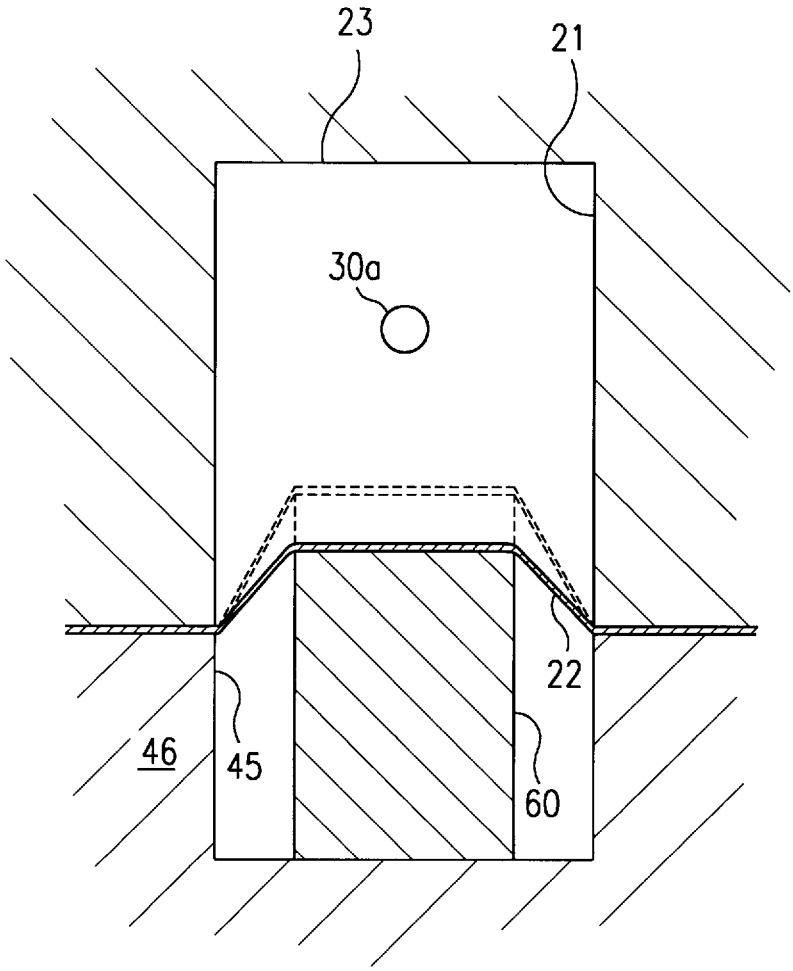
FIG. 32 is a modified state of a layered type piezoelectric body of FIG. 22 pressurizing the ink chamber.
Figure 33:
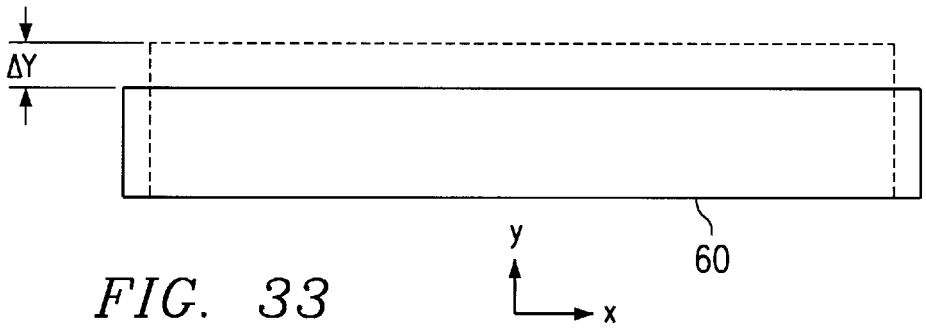
FIG. 33 is a side view of a modified state of a layered type piezoelectric body not attached to the substrate.

Next, a fifth embodiment using the above-mentioned layered type piezoelectric body 60 is described referring to FIG. 31 to FIG. 33.

As shown in FIG. 32, in the ink jet head of the third embodiment, the layered type piezoelectric body 60 is arranged in the above-mentioned concave portion 45 using the substrate 46 that forms the concave portion 45 opposite to the concave portion 21 of the top plate 20 which was used on the modified embodiment of the above-mentioned first embodiment. However, the layered type piezoelectric body 55 is not solidly attached to the substrate 46 at the region that corresponds to at least the ink chamber 23 or, more concretely, at the $S_4$ region shown in FIG. 31 but is held between the partition 22 and the above-mentioned bottom surface of the concave portion. Conversely, the layered type piezoelectric body 60 is attached to the substrate 46 at the rear end region that does not correspond to the ink chamber 23 or, more concretely, at the S5 region shown in FIG. 31. This is because it is necessary to accurately position the layered type piezoelectric body 60 with respect to the substrate 46 when wire bonding it to the individual electrode of each layered type piezoelectric body 60.

When voltage to the above-mentioned layered type piezoelectric body 60, the piezoelectric body will expand in the y direction by only ΔY in almost the entire region of the above-mentioned S4 region which excludes the area close to the S5 region attached to the substrate 46 as shown by the dotted lines in FIG. 33 along with a contraction in the x direction and the depth direction (i.e., a direction orthogonal to the paper plane in FIG. 33) displaying a deformation similar to when the piezoelectric body is not attached to the substrate 46 at all. Conversely, because either an individual electrode or a common electrode is arranged inside the S5 region of the layered type piezoelectric body 60, an electric field is not formed inside and deformation does not occur.

The deformation of the above-mentioned S4 region uses a thickness direction vibration mode in which each layer of the piezoelectric material deforms in the thickness direction (y direction) by means of an electric field formed parallel to the polarization direction. The deformation of each of these layers is added by only the number of layers allowing a large deformation amount ΔY to be obtained compared to the deformation amount Δy when an identical voltage is applied to the single layer piezoelectric body 26. And, as shown by the dotted lines in FIG. 33, the S4 region of the layered type piezoelectric body 60 functions by means of this deformation to sharply push up the partition 22 to reduce the capacity of the ink chamber 23. This propels the pressurized ink from the nozzle hole 30*a* in a fluid droplet shape.

Thus, because the S4 region which forms the functional portion of the layered type piezoelectric body 60 in the ink jet head of the fifth embodiment is not fixed to the substrate 46 and the upper surface adjacent to the partition 22 of this S4 region uniformly expands and displaces by only ΔY by means of the thickness direction vibration mode to pressurize the ink chamber 23, there is no loss of displacement due to the upper surface of the piezoelectric body deforming like a wave as in the case when the entire surface is attached to the substrate and, furthermore, there is no instability in the diameter of the ink droplets to be propelled due to bending in the piezoelectric body resulting in changes to the pressurized state of the ink chamber 23 as in the case when a lengthwise direction extension vibration mode is used. Therefore, according to this embodiment, stable ink propulsion with good efficiency can be achieved.

Furthermore, in the above-mentioned fifth embodiment, the layered type piezoelectric body 60 is solidly attached to the substrate 46 at the S5 region in order to accurately position the layered type piezoelectric body 60 with respect to the substrate 46. However, the layered type piezoelectric body 60 can be fixed by means of partially forming the width of the above-mentioned concave portion 45 corresponding to the above-mentioned S5 region almost equal to the width of the layered type piezoelectric body 55 and then applying pressure to the above-mentioned S5 region to hold the piezoelectric body to the wall of the concave portion 45. For this case, the objective of the positioning with respect to the substrate 46 can be achieved even if the layered type piezoelectric body 60 is not attached to the substrate 46 at all thus allowing results similar to the above-mentioned third embodiment to be obtained. Moreover, if the positioning of the layered type piezoelectric body 60 with respect to the substrate 46 can be done using methods other than attachment or holding, the entire layered type piezoelectric body 60 can be maintained by only gripping it between the partition 22 and the substrate 46.

Furthermore, in the above-mentioned fifth embodiment, an example in which the piezoelectric body 60 underwent the polarization process in the upper and lower direction in FIG. 31 was described. However, a piezoelectric body can be used that undergoes the polarization process in the left and right direction in FIG. 31 in like manner to the fourth embodiment. For this case, a larger displacement can be obtained applying the same voltage, compared to the piezoelectric body of the above-mentioned fourth embodiment.

Thereupon, in each of the above-mentioned embodiments, it is preferable for the space between the piezoelectric body and the side wall of the substrate or the top plate 20 to be 50 $\mu$m or less and in particular 20 $\mu$m or less. These dimensions are to prevent as much as possible loss from occurring in the pressure used to spray the ink due to the partition being pressed and forced into the channel portion by the pressure of the ink occurring due to deformation of the piezoelectric body. When constructed this way, pressure loss can be reduced allowing low voltage drive along with increases in the drive stability of the piezoelectric body.

Figure 34:
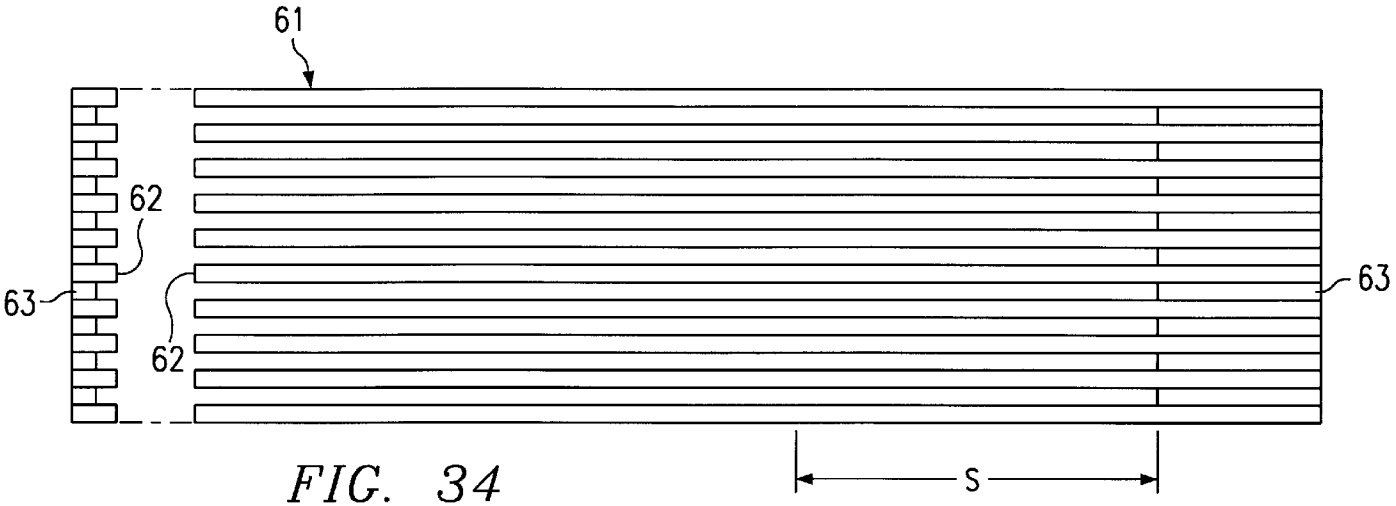
FIG. 34 is a plan view and a side view of a piezoelectric member formed in a comb-toothed shape.

In the above-mentioned first to fifth embodiments and their modified embodiments described above, as shown in FIG. 8., although a flat piezoelectric material with one portion attached and fixed to the substrate underwent a dicing process with each piezoelectric body completely divided to form long rectangular shapes, as shown in FIG. 34, the piezoelectric member 61 formed in a so-called comb-toothed shape can also be used. This piezoelectric member 61 is divided to form the long rectangular shape of each piezoelectric body 62 at the front region (left side in FIG. 34) including the attachment region S with the substrate. However, at the rear region of the above-mentioned attachment region S, each piezoelectric body 62 is coupled via a coupling portion 63 that has an upper surface even lower than the upper surface of each piezoelectric body 62 on which is formed the individual electrode.

Moreover, this coupling portion 63 is formed by making the cutting depth shallow at the position where it exceeded the attachment region s where the substrate is attached, when the flat piezoelectric material undergoes slit processing by means of dicing.

When constructed in this way, the strength of the construction of each piezoelectric body 62 increases and the durability and reliability of the ink jet head is improved. Furthermore, because the common electrode formed on the lower surface of each piezoelectric body 62 is connected at the rear region of the piezoelectric member 61 due to the existence of the above-mentioned coupling portion 63, the connection between the common electrode and the driver power supply is completed by connecting one location of the common electrode of this rear region and the conductor 13*a* on the top of the base plate 13 by means of wire bonding or solder. Therefore, it is not necessary to use a conductive adhesive agent for the attachment with the substrate 24 as in the case when dividing the member into long rectangular shapes to form the piezoelectric body 26.

Moreover, by forming the piezoelectric member 61 into a comb-toothed shape, the handling during the processes and assembly is simplified reducing assembly irregularities thereby allowing the manufacturing cost to be lowered.

[Material Used For Each Member]

Next, materials which can be used in the above-mentioned first to fifth embodiments and their modified embodiments are described.

Piezoelectric Material

The piezoelectric materials listed below can be used for the material of the above-mentioned piezoelectric bodies 26, 52, 55.

(1) Piezoelectric crystals

Crystals including crystal ($SiO_2$), Rochelle salt (RS: $NaKC_4H4O_6 \cdot 4H_2O$), ethylenediamine tartrate (ETD: $C_6H_{14}N_2O_6$), potassium tartrate (DKT: $K_2C_4H_4O_6$–½$H_2O$), secondary ammonium phosphate (ADP: $NH_4H_2PO_4$), perovskite family crystal (ex. $CaTiO_3$, $BaTiO_3$, PLZT), tungsten bronze family crystal (ex. $Na_xWO_3$ [0.1<x<0.28]), barium sodium niobate ($9NaN_{12}O_{15}$), potassium lead niobate ($P_9KN_{12}O_{15}$), lithium niobate ($LiNbO_3$), lithium tantalate ($LiTaO_3$), chloric acid soda ($NaClO_3$), tourmaline, zincblende (ZuS), lithium sulfate ($LiSO_4H_2O$), lithium methagallate ($LiGaO_2$), lithium iodate ($LiIO_3$), glycine sulfate (TGS), bismuth germanate ($Bi_{12}GeO_{20}$), lithium germanate ($LiGeO_3$), barium titanate, germanium ($9Ge_2TiO_3$).

(2) Piezoelectric semiconductors Wurtzite, BeO, ZnO, CdS, CdSe, AIN.

(3) Piezoelectric ceramics barium titanate ($BaTiO_3$), lead zirconate·lead titanate ($PbTiO_3 \cdot PbZrO_3$), lead titanate ($PbTiO_3$), barium lead niobate ((Ba—Pb) $N_9O_6$).

(4) The above-mentioned (1) piezoelectric crystal, (2) piezoelectric semiconductor and (3) piezoelectric ceramic powders can be broken down into plastic classes and formed.

(5) Piezoelectric polymers

Polyfluoride vinylidene PVDF (—$CH_2$—$CF_2$—)n, Polyfluoride vinylidene/PZT, rubber/PZT, copolymer of torifluoro ethylene and fluoride vinylidene, copolymer of vinylidene cyanide and vinylidene acetate or poly (vinylidende cyanide).

After the piezoelectric material presented above undergoes the polarization process, it can be processed as a piezoelectric body and then used or after being processed as a piezoelectric body, undergo a polarization process and be used.

Piezoelectric Overcoat Process

The overcoat process of the above-mentioned piezoelectric bodies 26, 52 can be carried out by means of methods (1) to (5) presented below.

(1) Applying a plastic

Thermoplastic resin including saturated polyester resin, polyamide resin, polyimide resin, acrylic resin, aramid resin, ethylene vinyl acetate resin, ion cross-link olefin copolymer (ionomer), styrene butadiene block copolymer, polyacetal, polycarbonate, vinyl chloride vinyl acetate copolymer, cellulose ester, polyimide or styrene resin.

Heat cured resin including epoxy resin, phenoxy resin, urethane resin, nylon type, silicon resin, fluoro silicone resin, phenol resin, melamine resin, xylene resin, alkyd resin or heat cured acrylic resin.

Photoconductive resin including polyvinyl carbazole, polyvinyl pyrene, polyvinyl anthracene or poly vinyl alcohol.

These can be used independently or in combination.

In addition, mixtures of engineered plastics such as liquid crystal polymer, plastics with powders or whiskers can be used as well. Photosensitive resin or thick film photoresist resin can be used. Bakelite (phenol resin), fluororesin and glass epoxy resin (epoxy with glass filler mixed in) can also be used. These can use well-known liquid application methods including painting, dipping or spraying.

From among the above-mentioned materials, the effects of polyimide resin, aramid resin, epoxy resin, phenoxy resin, fluoro silicone resin, fluororesin and glass epoxy resin are especially excellent.

(2) Vapor Deposition of Metal Oxide, Nitride and Sulfide Compounds

Coating the piezoelectric body with a metal oxide compound (such as $SiO_2$, SiO, CrO, $Al_2O_3$), a metal nitride compound (such as $Si_3N_4$, AlN), a metal sulfide compound (such as ZnS) or a combination of these using vacuum vapor deposition or sputtering.

Further, the plastics in the above-mentioned (1) can be applied by means of vapor deposition or parylene resin vapor deposition.

From among the above-mentioned materials, the effects of $Al_2O_3$ and $Si_3N_4$ are excellent.

(3) Application of Hydrocarbon Compounds

P-CVD (plasma CVD) is utilized to apply and overcoat the piezoelectric body with a IV group element contained hydrocarbon such as hydrocarbon, oxygen contained hydrocarbon and sulfur contained hydrocarbon; a halogen contained hydrocarbon such as nitrogen contained hydrocarbon, silicon contained hydrocarbon and fluorine contained hydrocarbon; or a III group element contained hydrocarbon. In addition, they can be applied by means of P-CVD under a mixing vapor phase of these.

From among the above-mentioned materials, the effects of fluorine contained hydrocarbon are excellent Moreover, depending on the compatibility of the adhesiveness with the piezoelectric body, these films require an undercoat to be suitably provided by means of a-Si (amorphous silicon), a-SiC or a-SiN.

(4) The plastic in the above-mentioned (1) forms the piezoelectric body by being substituted and impregnated in a piezoelectric formation portion by means of lowering the voltage in place of applying the plastic to the surface of the piezoelectric body plate surface in a liquid application state.

(5) Processing the surface of the piezoelectric body plate using a solvent with ink repelling properties.

If the overcoat films formed using the methods presented in (1) to (5) above are compared, the following characteristics can be seen (However, (3) is for with an undercoat.)

[i] Strength:

Strong (2), (3)>(1), (4)>(5) Weak

[ii] Smoothness:

Good (1), (4)>(2), (3), (5) Poor

[iii] Adhesive property (Including anti-vibration property.):

Strong (1), (4)>(2), (3)>(5) Weak

[iv] Durability (Including anti-ink property.)

Good (1), (4)>(2), (3)>(5) Poor

In addition, (5) is a convenient process and can also be utilized as the processes following (1) through (4). (1) and (4) are especially economical from the viewpoint of cost.

Moreover, the methods presented in the above-mentioned (1) to (5) can be suitably combined and used in accordance with the type of piezoelectric body and ink.

Top Plate and Substrate Materials

The following groups (1) to (4) can be used as the non-piezoelectric material comprising the top plate 20 and the substrate 24.

(1) Ceramics $Al_2O_3$, SiC, C, $BaTiO_3$, $BiO_3 \cdot 3SnO_2$, Pb $(Zr_x, Ti_{1-x})O_3$, ZnO, $SiO_2$, (1−x) Pb $(Zr_x, Ti_{1-x},)$ $O_3$+(x) $L_2O_3$, $Zn_{1-x}Mn_xFe_2O_3$, $\gamma$−$Fe_2O_3$, $Sr \cdot 6Fe_2O_3$, $L_{1-x}Ca_xCrO_3$, $SnO_2$, transition metal oxide, ZnO —$Bi_2O_3$, semiconductor $BaTiO_3$, $\beta$—$Al_2O_3$, stabilized zirconia, $La_{13}$, 11C, diamond, TiN, TiC, $Si_3N_4$, $Y_2O_2S$:Eu, PLZT, $ThO_2$, —$CaO \cdot nSiO_2$, $C_5$(F, Cl) $P_3O_1$2, $TiO_2$, $K_2O \cdot nAl_2O_3$.

(2) Glass

Element glass=Si, Se, Te, As

Hydrogen bond glass=$HPO_3$, $H_3PO_4$, $SiO_2$, $9O_2$, $P_2O_5$, $GeO_2$, $AS_2O_3$ Glass oxide=$SbO_3$, $Bi_2O_3$, $P_2O_3$, $V_2O_5$, $S9O_5$, $AS_2O_3$, $So_3$, $ZrO_2$ Glass fluoride=$BeF_2$, Glass chloride=$ZnCl_2$ Glass sulfide=$GeS_2$, $AS_2S_3$ Glass carbonate=$K_2CO_3$, $MgCO_3$ Glass nitrate=$NaNO_3$, $KNO_3$, $AgNO_3$ Glass sulfpate=$Na_2S_2O_3$, $H_2O$, $Tl_2Si_4$, alum Silicate glass=$SiO_2$ Silicate alkali glass=$N_2O$—CaO—$SiO_2$ Potassium lime glass=$K_2O$—CaO—$SiO_2$ Soda lime glass=$Na_2O$—CaO—$SiO_2$ Lead glass Barium glass Borosilicate glass (3) Plastics Thermoplastic resin including saturated polyester resin, polyamide resin, polyimide resin, aramid resin, acrylic resin, ethylene vinyl acetate resin, ion cross-link olefin copolymer (ionomer), styrene butadiene block copolymer, polyacetal, polycarbonate, vinyl chloride vinyl acetate copolymer, cellulose ester, polyimide or styrene resin.

Heat cured resin including epoxy resin, urethane resin, nylon resin, silicon resin, phenol resin, melamine resin, xylene resin, alkyd resin or heat cured acrylic resin.

Photoconductive resin including polyvinyl carbazole, polyvinyl pyrene, polyvinyl anthracene or poly vinyl alcohol.

The materials in (1) to (3) presented above can be used independently or in combination.

In addition, mixtures of engineered plastics such as liquid crystal polymer or plastics with powders or whiskers can be used as well.

Photosensitive resin or thick film photoresist resin can be used. Bakelite (phenol resin), fluororesin and glass epoxy resin (epoxy with glass filler mixed in) can also be used.

(4) Others

All metals can be used when an insulating film coat is applied to the side adjacent to the ink chamber.

These non-piezoelectric materials can either be processed into the top plate 20 after being made into a plate-like shape or formed into the shape of the top plate 20, or formed into the shape of the top plate 20 from the start using a die, pattern etching or optical hardening.

Partition Material

The groups shown below can be used as the material of the above-mentioned partitions 22, 48.

(1) Heat cured resin including epoxy resin, phenoxy resin, urethane resin, nylon, silicon resin, fluoro silicone resin, phenol resin, melamine resin, xylene resin, alkyd resin or heat cured acrylic resin.

From among the above-mentioned resins, epoxy resin, phenoxy resin and fluoro silicone resin can be appropriately used in particular.

(2) Thermoplastic resin including saturated polyester resin, polyamide resin, acrylic resin, aramide resin, ethylene vinyl acetate resin, ion cross-link olefin copolymer (ionomer), styrene butadiene block copolymer, polyacetal, polyphenylene sulfide, polycarbonate, vinyl chloride vinyl acetate copolymer, cellulose ester, polyimide or styrene resin.

From among the above-mentioned materials, aramide resin, polyimide resin, polyamide resin and ethylene vinyl acetate resin can be used appropriately in particular.

(3) Liquid crystal polymer (4) Photosensitive resin, thick film photoresist resin (5) Rubber, synthetic rubber (6) Thin plates including nickel, stainless steel, titanium or tungsten Further, the materials in (1) to (5) presented above can be used independently or in combination.

If the superior and inferior points of the materials presented in (1) to (6) above are compared, (1) to (3) are almost identical.

The following comparison can be seen.

Superior (1)~(3)>(4)>(6)>(5) Inferior

Furthermore, it is preferable for the thickness of the material to be 100 $\mu$m or less and, if possible, 50 $\mu$m or less.

Adhesive Agent Material

The following groups (1) to (4) can be used for the material of the adhesive agent used to assemble the ink jet head 12. However, the adhesive agent used to attach the piezoelectric body 26 to the substrate 24 must be conductive.

(1) Heat cured resin adhesive agent including epoxy resin, phenol resin, phenoxy resin, acrylic resin, furan resin, polyurethane resin, polyimide resin, or silicon resin.

(2) Thermoplastic resin adhesive agent including polyvinyl acetate, polyvinyl chloride, vinyl acetyl, polyvinyl alcohol, or polyvinyl butyral.

(3) UV cured resin adhesive agent (4) Anaerobic cured adhesive agent

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An ink jet head comprising:

a first member;

a piezoelectric member which is provided on said first member, said piezoelectric member having a strip shape extending in a longitudinal direction, a longitudinal length in said longitudinal direction, and a first surface and a second surface, each surface being parallel to said longitudinal direction, wherein said first surface faces said first member and a segment of said first surface is fixedly connected to said first member, said segment having a length less than said longitudinal length, and said second surface is opposite said first surface;

a second member in which a groove is formed corresponding to said piezoelectric member; and a film, said film being provided on said second member to cover said groove, to form an enclosed ink chamber for maintaining a volume of ink, wherein said first member is assembled with respect to said second member via said film so that said second surface of said piezoelectric member pushes said film into said ink chamber even when no electric field is applied to said piezoelectric member.

2. An ink jet head as claimed in claim 1, further comprising:

a driver which is connected to said piezoelectric member to induce a displacement of at least a portion of said piezoelectric member, which pushes said film further into said ink chamber when in an operative position.

3. An ink jet head as claimed in claim 2, wherein said driver includes a pair of electrodes, one of which is disposed on said first surface and the other of which is disposed on said second surface, to enable an electric field to be formed between said pair of electrodes.

4. An ink jet head as claimed in claim 3, wherein said piezoelectric member is poled in a direction parallel to a direction in which the electric field is formed.

5. An ink jet head as claimed in claim 1, wherein said piezoelectric member is coated with a resin material.

6. An ink jet head as claimed in claim 5, wherein said resin material is polyimyde resin.

7. An ink jet head comprising:

a member in which an ink chamber is formed, said ink chamber having a membrane wall, said membrane wall having a deformed shape which protrudes away from said member; and a piezoelectric member which is disposed adjacent to said membrane.

8. An ink jet head as claimed in claim 7, wherein said ink chamber is a groove formed in said member, and said membrane covers said groove to form a wall of said ink chamber.

9. An ink jet head as claimed in claim 7, wherein said member and said membrane are integrally formed into one body.

10. An ink jet head as claimed in claim 7, wherein said piezoelectric material is coated with a resin material.

11. An ink jet head as claimed in claim 10, wherein said resin material is polyimyde resin.

12. An ink jet head as claimed in claim 7, further comprising:

a driver which is connected with said piezoelectric member to drive said piezoelectric member.

13. An ink jet head as claimed in claim 12, wherein said driver includes a pair of electrodes, one of which is disposed on a first surface of said piezoelectric member, said first surface facing said membrane, and the other of which is disposed on a second surface, said second surface opposing said first surface, to enable an electric field to be formed between said pair of electrodes.

14. An ink jet head as claimed in claim 13, wherein said piezoelectric member is poled in a direction parallel to a direction in which the electric field is formed.

15. An ink jet head as claimed in claim 7, wherein said deformed shape is arcuate.

16. An ink jet head comprising:

a first member having a first surface in which a plurality of first grooves are formed;

a film which is provided on said first surface to cover said first grooves, thus forming a plurality of enclosed ink chambers for maintaining a volume of ink therein;

a second member having a second surface in which a plurality of second grooves are formed, wherein each second groove respectively corresponds to a first groove, and in an assembled position, said film is interposed between said first member and said second member and each of second grooves confronts a respective one of said first grooves; and a plurality of piezoelectric members, where a piezoelectric member is respectively provided in each of said plurality of second grooves.

17. An ink jet head as claimed in claim 16, wherein each second groove has an interior wall and each piezoelectric member has a first surface, wherein said first surface faces said interior wall and a gap formed between said interior wall and said surface is 50 $\mu$m or less.

18. An ink jet head as claimed in claim 17, wherein said gap is 20 $\mu$m or less.

19. An ink jet head as claimed in claim 16, wherein said film is pushed into said ink chambers by said piezoelectric member.

20. An ink jet head as claimed in claim 16, wherein said film has a plurality of arched portions corresponding to said first grooves.

21. An ink jet head as claimed in claim 20, wherein in said assembled position, each of said arched portion projects toward said second member.

22. An ink jet head comprising:

a piezoelectric member which has a first longitudinal surface and a second longitudinal surface opposing to said first surface;

a first member in which an ink chamber is formed, said ink chamber having a membrane wall which forms a portion of an outer surface of said first member, said first surface of said piezoelectric member being in contact with said portion; and a second member which is in contact with said second surface of said piezoelectric member, wherein said piezoelectric member is nipped between said first member and said second member.

23. An ink jet head as claimed in claim 22, wherein said ink chamber is a groove formed in said first member;

wherein said membrane is disposed on said first member to cover said groove so as to form said ink chamber.

24. An ink jet head as claimed in claim 22, further comprising:

a driver which is connected to said piezoelectric member to induce a displacement of said piezoelectric member.

* * * * *